US006471347B1

(12) United States Patent
Koitabashi et al.

(10) Patent No.: US 6,471,347 B1
(45) Date of Patent: Oct. 29, 2002

(54) INK PRINTING METHOD AND INK PRINTING APPARATUS

(75) Inventors: Noribumi Koitabashi, Yokohama; Hitoshi Tsuboi, Tokyo, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/470,221

(22) Filed: Dec. 22, 1999

(30) Foreign Application Priority Data

Dec. 25, 1998 (JP) ..... 10-376677

(51) Int. Cl.[7] ..... B41J 2/17
(52) U.S. Cl. ..... 347/98; 347/100
(58) Field of Search ..... 347/98, 100, 43, 347/101, 21; 106/31.27, 31.28, 31.58

(56) References Cited

U.S. PATENT DOCUMENTS 5,640,187 A * 6/1997 Kashiwazaki et al. ..... 347/101
6,012,809 A * 1/2000 Ikeda et al. ..... 347/101
6,074,052 A * 6/2000 Inui et al. ..... 347/101

FOREIGN PATENT DOCUMENTS

JP 10-226055 8/1998

OTHER PUBLICATIONS

U.S. patent application Ser. No. 09/469,514, Koitabashi, Dec. 22, 1999, pending.
U.S. patent application Ser. No. 09/469,304, Koitabashi, Dec. 22, 1999, pending.
U.S. patent application Ser. No. 09/468,839, Koitabashi et al., Dec. 22, 1999, pending.
U.S. patent application Ser. No. 09/468,117, Koitabashi et al., Dec. 21, 1999, pending.
U.S. patent application Ser. No. 09/219,895, Koitabashi, Dec. 24, 1998, pending.
U.S. patent application Ser. No. 09/217,940, Koitabashi, Dec. 22, 1998, pending.
U.S. patent application Ser. No. 08/840,773, Inni et al., Apr. 16, 1997, patented, date Jun. 13, 2000, Pat. No. 6,074,052.

* cited by examiner

*Primary Examiner*—Michael Nghiem
*Assistant Examiner*—Shih-wen Hsieh
(74) *Attorney, Agent, or Firm*—Fitzpatrick, Cella, Harper & Scinto

(57) ABSTRACT

A processing liquid containing an insolubilizer of polymer as the insolubilizer is thinned out at a relatively low printing ratio, i.e., at a given ratio relative to dots of a black ink and applied after the Bk ink is applied. Thereby, a reacting product is fixed in a part relatively shallow and close to the surface of a printing medium without diffusing deep into the medium and thus can increase optical density of a printed ϕ image. In this case, the fixation can be accelerated when the processing liquid is highly penetrative.

29 Claims, 19 Drawing Sheets

Bk INK DOT

PROCESSING LIQUID

INK PRINTING METHOD AND INK PRINTING APPARATUS

This application is based on Patent Application No. 10-376677 (1998) filed Dec. 25, 1998 in Japan, the content of which is incorporated hereinto by reference.

BACKGROUND OF THE INVENTION

1. Field of the Invention

The present invention relates to an ink printing method and an ink printing apparatus, and more particularly to the ink printing method and the ink printing apparatus which perform printing by using a processing liquid to promote insolubilization or solidification of a pigment in an ink. The ink printing method and the ink printing apparatus of the present invention are applicable to equipment such as a printer, a copy machine, a facsimile machine or the like, which prints letters, images or the like on a printing medium such as paper or the like, and also as a printing mechanism for such equipment.

2. Description of the Prior Art

To secure a high optical reflection density (hereinafter referred to as "OD") has been one of the important technical themes for ink printing. Electrophotography is a printing technique which realizes a relatively high OD, and ink printing has been required to secure an OD as high as that associated with the electrophotography.

The assignee of the present invention has proposed to use a liquid which promotes solidification of a colorant, e.g., dye or pigment, in the ink for improving waterproofness of a printed matter. Such a liquid is hereinafter referred to as a processing liquid. Japanese Patent Application Laid-Open No. 10-226055 (1998) mentions the processing liquid containing polyvalent metallic ions or a high-molecular-weight polymer as the solidification promoter for the colorant, e.g., pigment or dye, in ink. This document discloses a technique to secure uniform images on a printing medium for forward-and-backward printing, where proportion of the processing liquid is reduced in the backward printing than in the forward printing, noting that the image density and dot diameter are different in the forward and backward printing.

The inventors of the present invention have analyzed the images produced by a known ink containing a pigment and the reaction between the processing liquid and the pigment to find that the dot diameter conversely decreases as a reaction between the processing liquid and the pigment proceeds, because of the promoted coagulation or solidification. In other words, increasing coagulation rate and increasing image density are technical objectives which run counter to each other.

The inventors of the present invention, therefore, have concluded that it is necessary to develop a technique which can adequately control at least one of the image quality conditions, e.g., image density, dot shape and dot area, with an ink containing such a pigment.

The inventors of the present invention have found, after having extensively studied, a new technical necessity which cannot be satisfied by first applying the processing liquid to the printing medium, followed by applying the ink droplets. The necessary technique for use of the processing liquid is to create the phenomena of promoting coagulation of the pigment by the reaction with the liquid and, at the same time, diffusing the pigment, to form an image that is excellent in fixation and image quality. It should be noted that these phenomena run counter to each other.

SUMMARY OF THE INVENTION

The main object of the present invention is to provide a novel ink printing method and a novel printing apparatus which give, when a pigment-containing ink is used, an image of desired image density.

It is another object of the present invention to provide a novel ink printing method and a novel printing apparatus which form, with the aid of a pigment-containing ink, an image of higher and/or lower density, or image of more multi level of density or more desired tone image than a case when the processing liquid is used in correspondence one-to-one to the ink, while securing the image quality at a high fixation speed.

The ink printing method and the ink printing apparatus of the present invention are mainly characterized by use of a processing liquid of a "high penetrative" (e.g., that satisfies the standard described later) as the one to promote solidification of the pigment and by a smaller quantity of the processing liquid for use than the pigment-containing ink for a unit area, in order to achieve the above objects.

In a first aspect of the present invention, there is provided an ink printing method of forming an image on a printing medium by using an ink containing a pigment, the method comprising the step of:

applying a processing liquid which contains processing material for working to accelerate solidification of the pigment in the ink containing the pigment and shows high penetrability to the ink containing the pigment;

wherein the applying step differentiates applying of the processing liquid per unit area from applying quantity of the ink containing the pigment per unit area to form an image different in density from the image formed on the printing medium with the ink containing the pigment.

In a second aspect of the present invention, there is provided an ink printing method of performing printing by applying a processing liquid which works to accelerate solidification of a pigment after applying ink containing the pigment to a printing medium, wherein the processing liquid contains an insolubilizer of polymer and is highly penetrative and the processing liquid is applied at 50% or less in quantity of the ink applied to the printing medium.

In a third aspect of the present invention, there is provided an ink printing method, wherein an ink containing a pigment as a colorant and having a penetration coefficient Ka, which is a proportional coefficient for time span after penetration of the ink is started, when quantity of the ink penetrated is proportional to ½th order of, or the square root of, the time span, of less than 1.0 is applied onto a printing medium at a given quantity per unit area, and then a processing liquid coagulating the colorant by the reaction and having the penetration coefficient Ka of 5.0 or more is applied onto the printing medium at a given quantity per unit area.

In a fourth aspect of the present invention, there is provided an ink printing method, wherein an ink containing a pigment as a colorant and having a penetration coefficient Ka, which is a proportional coefficient for time span after penetration of the ink is started, when quantity of the ink penetrated is proportional to the square root of the time span, of less than 1.0 is applied in a thinned out manner onto a printing medium, and then a processing liquid containing an insolubilizer of polymer which coagulates the colorant by the reaction and having the penetration coefficient Ka of 5.0 or more is applied onto the printing medium in a thinned out manner.

In a fifth aspect of the present invention, there is provided an ink printing method of forming an image on a printing medium by using an ink containing a pigment, the method comprising the step of:

applying a processing liquid which contains processing material for working to accelerate solidification of the pigment in the ink containing the pigment and shows higher penetrability to the printing medium than that of the ink, to the ink containing the is pigment.

wherein the applying step differentiates applying of the processing liquid per unit area from applying quantity of the ink containing the pigment per unit area to form an image different in density from the image formed on the printing medium with the ink containing the pigment.

In a sixth aspect of the present invention, there is provided an ink printing apparatus for performing printing by applying a processing liquid which works to accelerate solidification of a pigment after applying ink containing the pigment to a printing medium, the apparatus comprising:

means for applying an ink containing a pigment as a colorant and having a penetration coefficient Ka, which is a proportional coefficient for time span after penetration of the ink is started, when quantity of the ink penetrated is proportional to the square root of the time span, of less than 1.0 is applied in a thinned out manner onto a printing medium, and then applying a processing liquid which coagulates the colorant by the reaction and having the penetration coefficient Ka of 5.0 or more is applied onto the printing medium in a thinned out manner, wherein the processing liquid contains an insolubilizer of polymer and is highly penetrative and the processing liquid is applied at a given rate of the ink applied to the printing medium.

In a seventh aspect of the present invention, there is provided an ink printing apparatus, wherein an ink containing a pigment as a colorant and having a penetration coefficient Ka, which is a proportional coefficient for time span after penetration of the ink is started, when quantity of the ink penetrated is proportional to the square root of the time span, of less than 1.0 is applied in a thinned out manner onto a printing medium, and then a processing liquid containing an insolubilizer of polymer which coagulates the colorant by the reaction and having the penetration coefficient Ka of 5.0 or more is applied onto the printing medium in a thinned out manner.

In an eighth aspect of the present invention, there is provided an ink printing apparatus for forming an image on a printing medium by using an ink containing a pigment, the method comprising:

image forming means for applying a processing liquid which contains processing material for working to accelerate solidification of the pigment in the ink containing the pigment and shows high penetrability to the ink containing the pigment, the means differentiating applying of the processing liquid per unit area from applying quantity of the ink containing the pigment per unit area to form an image different in density from the image formed on the printing medium with the ink containing the pigment, and varying applying amount means for varying the quantity of the high penetrative processing liquid per unit area which is applied by the image forming means according to density of an image to be formed.

In a ninth aspect of the present invention, there is provided an ink printing apparatus for forming an image on a printing medium by using an ink containing a pigment, the method comprising:

image forming means for applying a processing liquid which contains processing material for working to accelerate solidification of the pigment in the ink containing the pigment and shows higher penetrability to the printing medium than that of the ink, to the ink containing the pigment, the means differentiating applying of the processing liquid per unit area from applying quantity of the ink containing the pigment per unit area to form an image different in density from the image formed on the printing medium with the ink containing the pigment, and varying applying amount means for varying the quantity of the high penetrative processing liquid per unit area which is applied by the image forming means according to density of an image to be formed.

According to the above constitution, quantity of the processing liquid relative to the pigment-containing ink is decreased, because the liquid is applied at a restricted rate. Thus, an amount of the product of a reaction between the ink and the processing liquid penetrating deep in the thickness direction of a printing medium becomes smaller. As a result, the product spreads more over the printing medium surface. Therefore, the product tends to be concentrated and fixed in a relatively shallow portion of the medium, allowing the control of OD more easily. Keeping the containing rate of the processing liquid equal to or smaller than 50% of the pigment-containing ink allows an image of high density or conversely of low density, or an image of multiple ("multi") levels of density to be produced.

The "high-molecular-weight insolubilizer" for the present invention is acceptable, when constituent compounds having a molecular weight of 300 or more account for the majority. More preferably, it has an average molecular weight of 500 or more.

"Thinning" the processing liquid for the present invention may be effected by various methods, so long as it results in supplying a smaller quantity of the liquid than the pigment-containing ink for the unit area printed with the ink. For example, the liquid may be thinned out by the data processing or controlling the ejected quantity of the liquid, or ejected at a predetermined rate.

"Insolubilization" for the present invention includes complete insolubilization, needless to say, promotion of solubilization by the aid of an insolubilizer, and practical insolubilization, i.e., the pigment becomes mostly insoluble (e.g., 80% or more, or 90% or more), although left soluble partly.

The above and other objects, effects, features and advantages of the present invention will become apparent from the following description of embodiments thereof taken in conjunction with the accompanying drawings.

DESCRIPTION OF THE PREFERRED EMBODIMENTS

Figure 1:
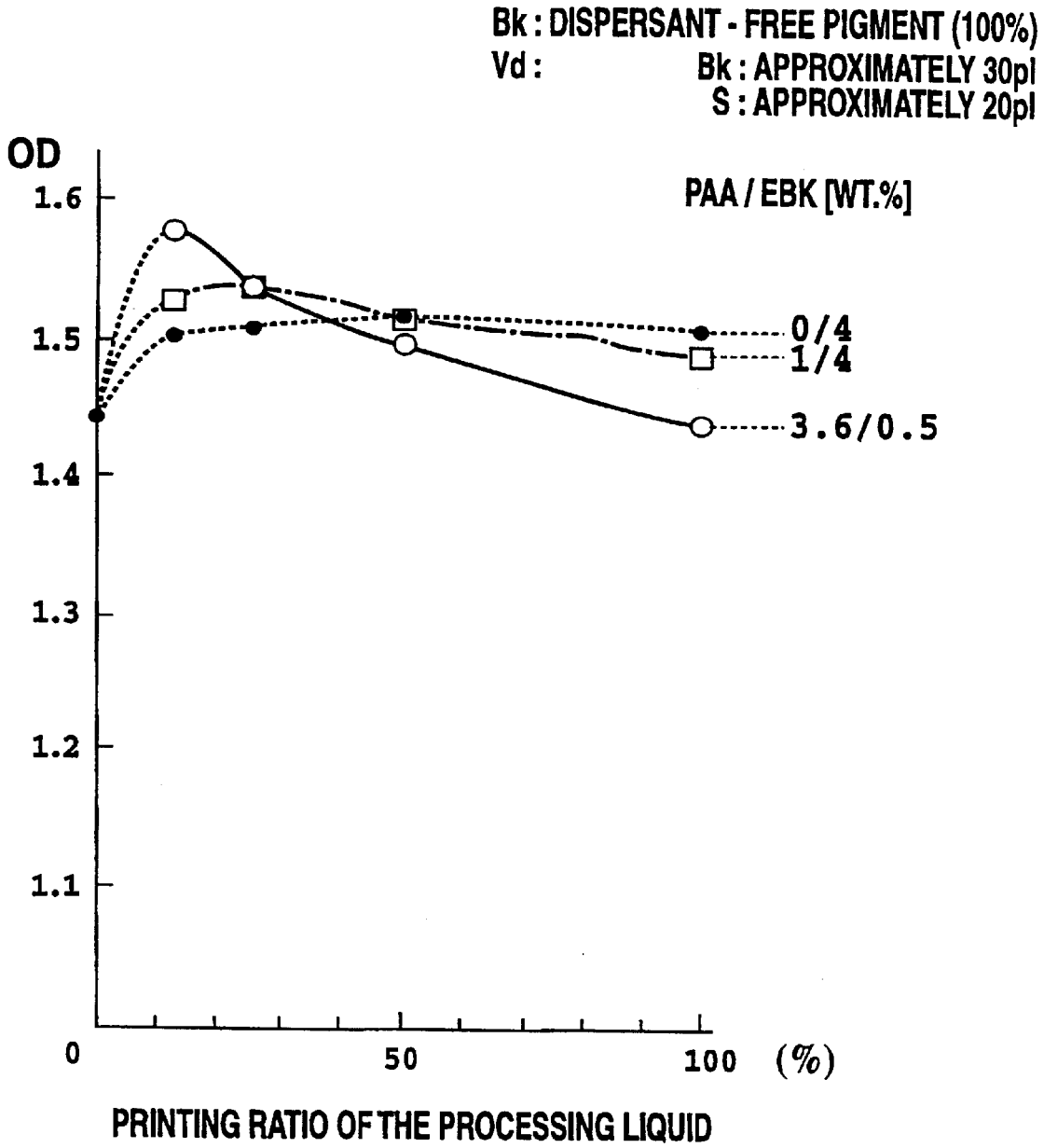
FIG. 1 is a graph showing the relationship between OD and printing ratio of the processing liquid according to one embodiment of the present invention.

The preferred embodiments of the present invention are described by referring to the drawings.

(Embodiment 1)

The first embodiment of the present invention uses the processing liquid to be applied at a lower printing duty than the ink, where the processing liquid is applied at a thinned-out rate according to ink-applied pixels. More concretely, the processing liquid is thinned out in such a way to effectively optimize insolubilization and penetration (fixation) of the processing liquid, and thereby to realize high-OD printing and, at the same time, to solve the above-mentioned problems related to such as fixation or the like.

The printing system of this embodiment is developed, based on results of various tests described below and estimation derived therefrom. The test conditions will be described below.

An ink jet printer uses print heads respectively ejecting a black (Bk) ink and a processing liquid (S), where an ejected rate of the Bk ink is set at 20 pl or 30 pl per one droplet and on the other hand, that of the processing liquid at 20 pl per one droplet. These two print heads are moved relative to a printing medium to eject the Bk ink first and the processing liquid next so that they are placed one on the other on the printing medium. In this case, ejection time difference is 0.2 sec. Several tests, other than the test described below, used ejection time difference varying in a range from 0.1 sec. to 0.4 sec, which showed little effect of the time difference in the above range.

The Bk ink contains 0.1% to 0.2% of acetylenol EH (trade name of Kawaken Fine Chemicals Co., Ltd., ethylene oxide-2,4,7,9-tetramethyl-5-decyne-4,7-diol, hereinafter referred to simply as acetylenol), and also contains only a pigment (which needs a dispersant or does not (self-dispersing type)) or a mixture of pigment and dye. The Ka value representing penetrability of the Bk ink (described later) was set at a range of 0.3 to 0.5 ($ml \cdot m^{-2} \cdot msec^{1/2}$).

The processing liquid contains 2.0% of acetylenol EH and is used in all of the tests. As a result, it has relatively high penetrability. Two types of cationic insolubilizers are used for the processing liquid, either alone or in combination at a predetermined rate. One is polyarylamine (hereinafter referred to as PAA) having a molecular weight of 1500 or less (average molecular weight: approximately 1000) mixed with the same quantity of acetic acid. The other is benzalkonium chloride (hereinafter referred to as EBK). The processing liquid contains PAA (and hence acetic acid) at 3.6 wt. % and EBK at 0.5 wt. %, unless otherwise stated. It should be noted that in FIGS. 1 and 3 respectively of experimental examples 1 and 2 described below, several combinations of quantity of the respective PAA and EBK are shown as, for example, 3.6/0.5.

EXPERIMENTAL EXAMPLE 1

FIG. 1 shows OD changing with changing of printing ratio (printing duty) of the processing liquid, in which the changing is shown within parameters of content ratios (wt. %) of PAA and EBK contained in the processing liquid. In this changing, OD is measured for the dot patterns formed by the ink and processing liquid at liquid printing ratios of 12.5, 25, 50 and 100% for pixel density of 600 dpi. In Experimental Example 1, the Bk ink contains a self-dispersing type pigment (hereinafter referred to as dispersant-free pigment) as the sole colorant, and its ejection amount is set at around 30 pl.

As shown in FIG. 1, the relationships between OD and printing ratio generally have a tendency that OD increases as printing ratio decreases to a certain level. It may be estimated that this phenomenon is caused by the following mechanism, which is schematically and orderly illustrated in FIGS. 2A to 2F.

Figure 2:
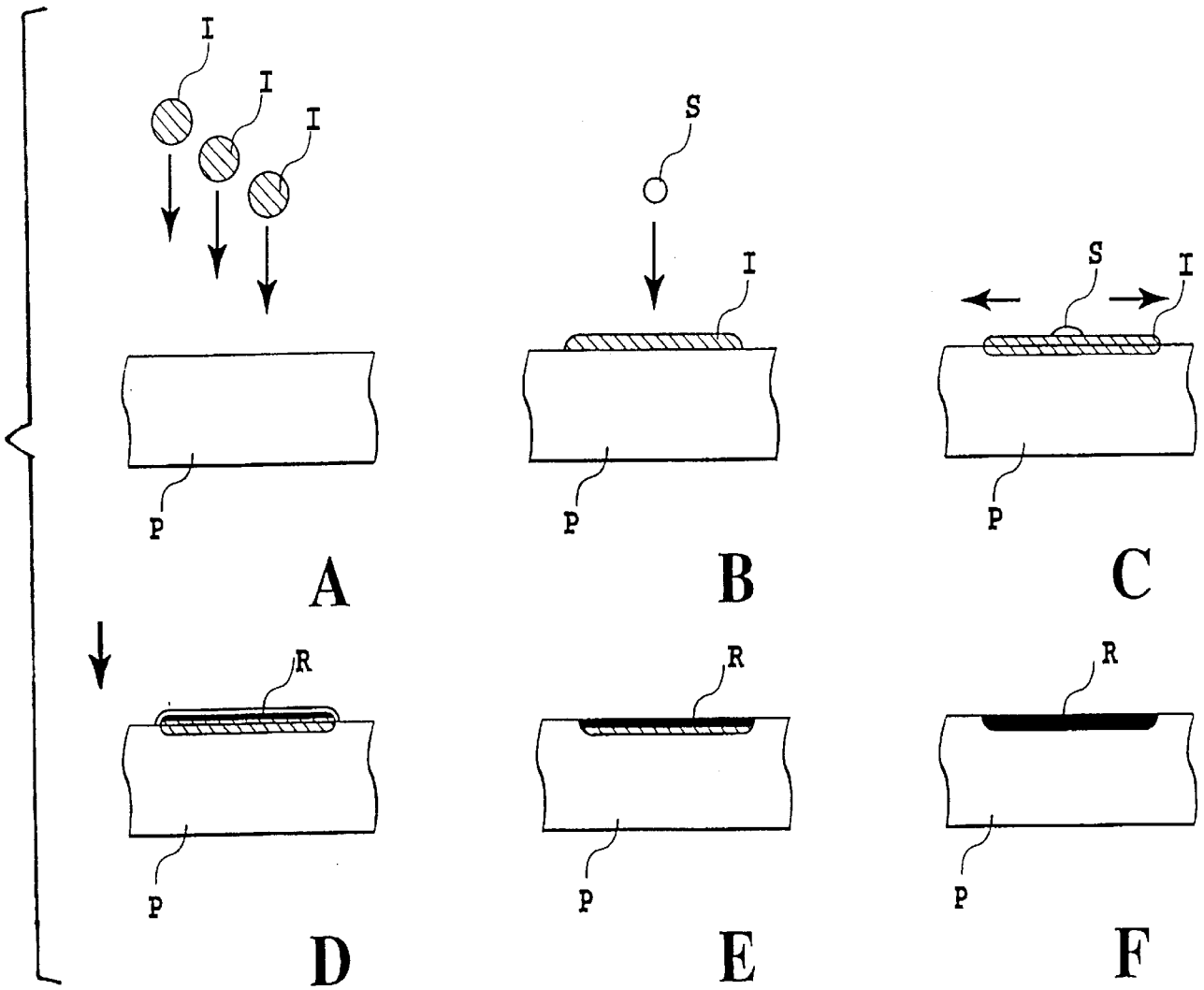
FIGS. 2A to 2F are illustrations illustrating fixation of the product of the reaction between the ink and processing liquid according to one embodiment of the present invention.

Firstly, the ink I is ejected at a printing ratio of 100% with respect to the pixel density of 600 dpi as shown in FIG. 2A, to form a pattern with the ink as shown in FIG. 2B. Later, the thinned-out processing liquid S of relatively high penetrability is ejected to the pattern. As shown in FIGS. 2C, 2D, on contacting with the surface of the ink which is not fully penetrated into the printing medium, the processing liquid quickly penetrates and diffuses (moves) in the horizontal direction (arrowed direction in the figure) along the medium surface. A liquid as a product of reaction between the ink and processing liquid moves, although to a limited extent.

At a low printing ratio of the processing liquid, i.e., when the processing liquid is thinned out greatly, it is sufficiently small in quantity relative to that of the ink, and its quantity moving in the thickness direction is limited. As a result, the processing liquid distributed uniformly over the ink starts to react with the ink uniformly from its surface, as shown in FIG. 2E, coagulating and insolubilizing the pigment in the vicinity of a surface of the ink. This process forms a thin film of the coagulated substance, when the processing liquid contains a polymer (e.g., PAA in this Experimental Example), as the insolubilizer, having polarity opposite to that of the pigment in the ink. Thus, the reaction between the ink and solution starts mainly from the surface ink layer, and, at the same time, they gradually penetrate into the printing medium while reacting with each other, as shown in FIG. 2F.

In the above described process, the pigment coagulated or insolubilized by the processing liquid tends to remain and to be fixed in the shallow portion of the printing medium because the processing liquid is thinned out to limit its quantity relative to that of the ink, thereby reducing the quantity of the processing liquid which penetrates deeper. As a result, OD tends to increase as the processing liquid decreases in printing ratio (or is thinned out more) to a ceratin level. The large amount of the reacted product remains in the shallow portion of the printing medium, and improves a property related to strike-through (the printed medium has better property related to strike-through, when density of the image it carries, observed from the back side of the printing medium, is lower). Further, an improvement of fixation results from use of the solution of high penetrability.

The above results generally indicate trends that OD increases as printing ratio of-the processing liquid decreases, when the processing liquid contains PAA (the cases marked with "□" and "○" in FIG. 1), and this trend becomes less notable as PAA content ratio decreases (the case marked with "□" in FIG. 1). When the processing liquid contains EBK as the sole insolubilizer (i.e., containing no PAA), OD is essentially constant is irrespective of the printing ratio (the cases marked with "●" in FIG. 1).

The horizontal movement of the processing liquid after it lands on the printing medium (FIGS. 2C and 2D) is accompanied with the movement of the product of the reaction between the ink and processing liquid in the same direction, although to a limited extent, by which is meant that a fine gap between the dots can be filled by the ink or the like, even when an area factor (ratio of the ink dot to the printed surface on the medium, referred as AF) is lower than 100%.

Even if the individual ink dots are formed with being thinned out, in a case that they are not separated from each other but connected to each other, the processing liquid can move through the connection (FIGS. 2C and 2D), to secure the processing liquid uniformly distributed over the ink.

EXPERIMENTAL EXAMPLE 2

Figure 3:
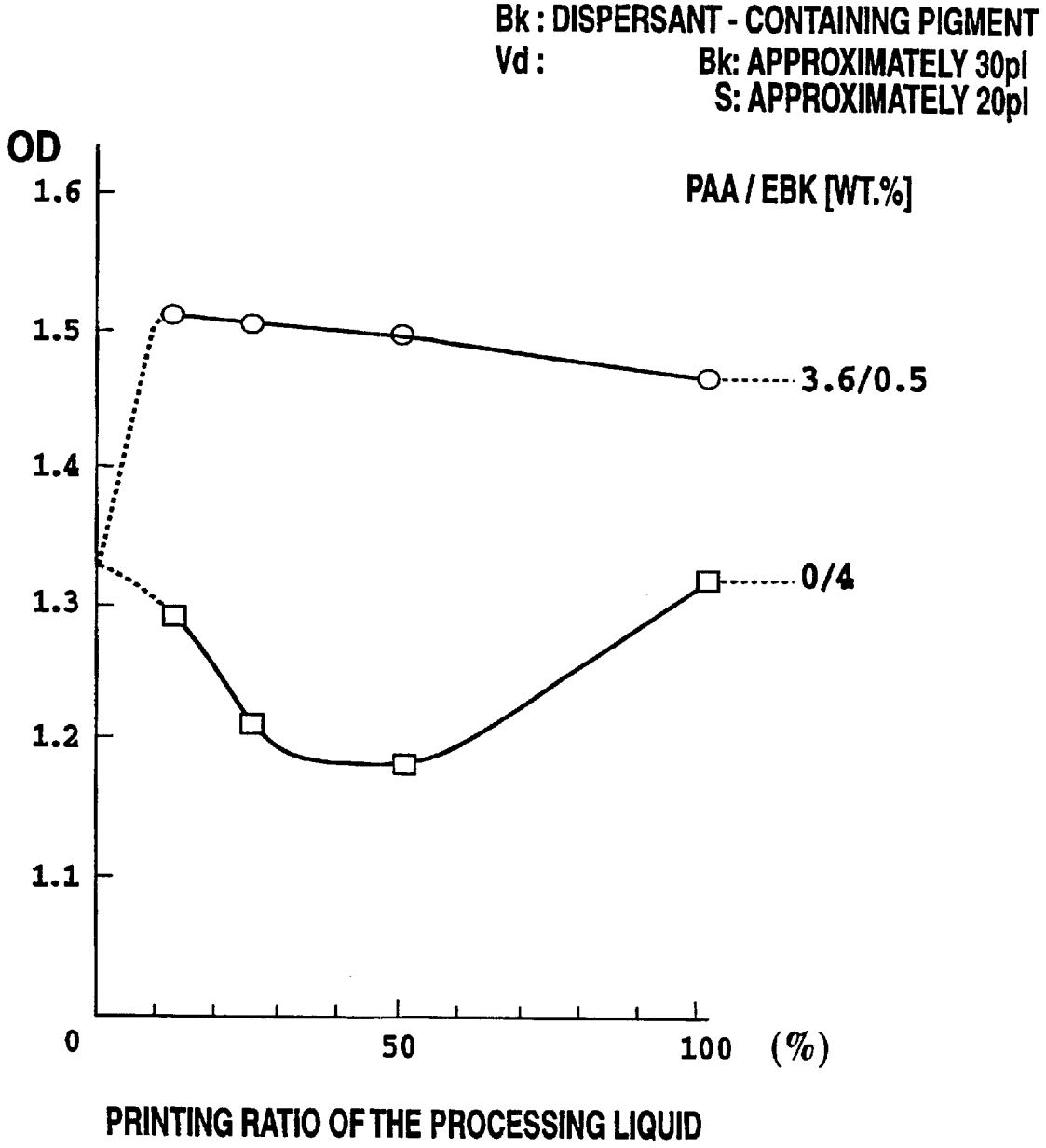
FIG. 3 is a graph showing the relationship between OD and printing ratio of the processing liquid according to another embodiment of the present invention.

FIG. 3 shows a relationship between OD and a printing ratio of the processing liquid for Experimental Example 2, similar to that shown in FIG. 1 for Experimental Example 1. The same procedure as used for Experimental Example 1 is repeated, except that the colorant for the Bk ink is replaced by a pigment dispersed with a dispersant of styrene/acrylic copolymer.

It is apparent, when the results shown in FIG. 3 are compared with those shown in FIG. 1 for Experimental Example 1 with the dispersant-free pigment, OD is less sensitive to change in printing ratio of the processing liquid.

This phenomenon conceivably results from the effect of intertwinement between the polymer (PAA) in the processing liquid and polymer (dispersant) in the ink to greatly accelerate a reaction between the ink and processing liquid, limiting the horizontal movement of the reacted liquid itself between the ink and processing liquid and forming a solid coating film of the reacted product, to retard penetration of the processing liquid in the medium thickness direction. This can be supported by at least 2 times longer fixation time than that observed in Experimental Example 1 with the dispersant-free pigment.

EXPERIMENTAL EXAMPLE 3

Figure 4:
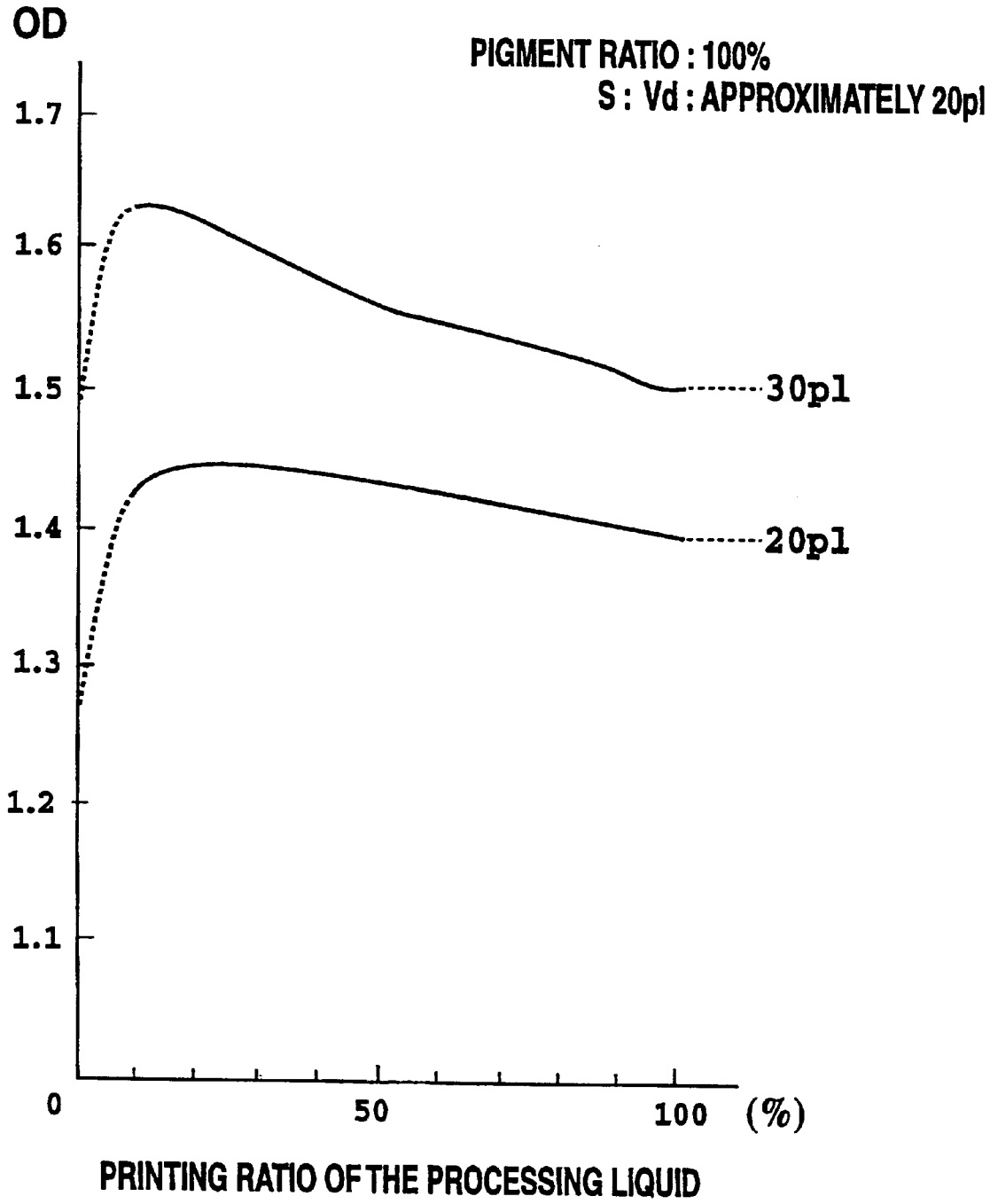
FIG. 4 is a graph showing the relationship between OD and printing ratio of the processing liquid according to still another embodiment of the present invention.
Figure 5:
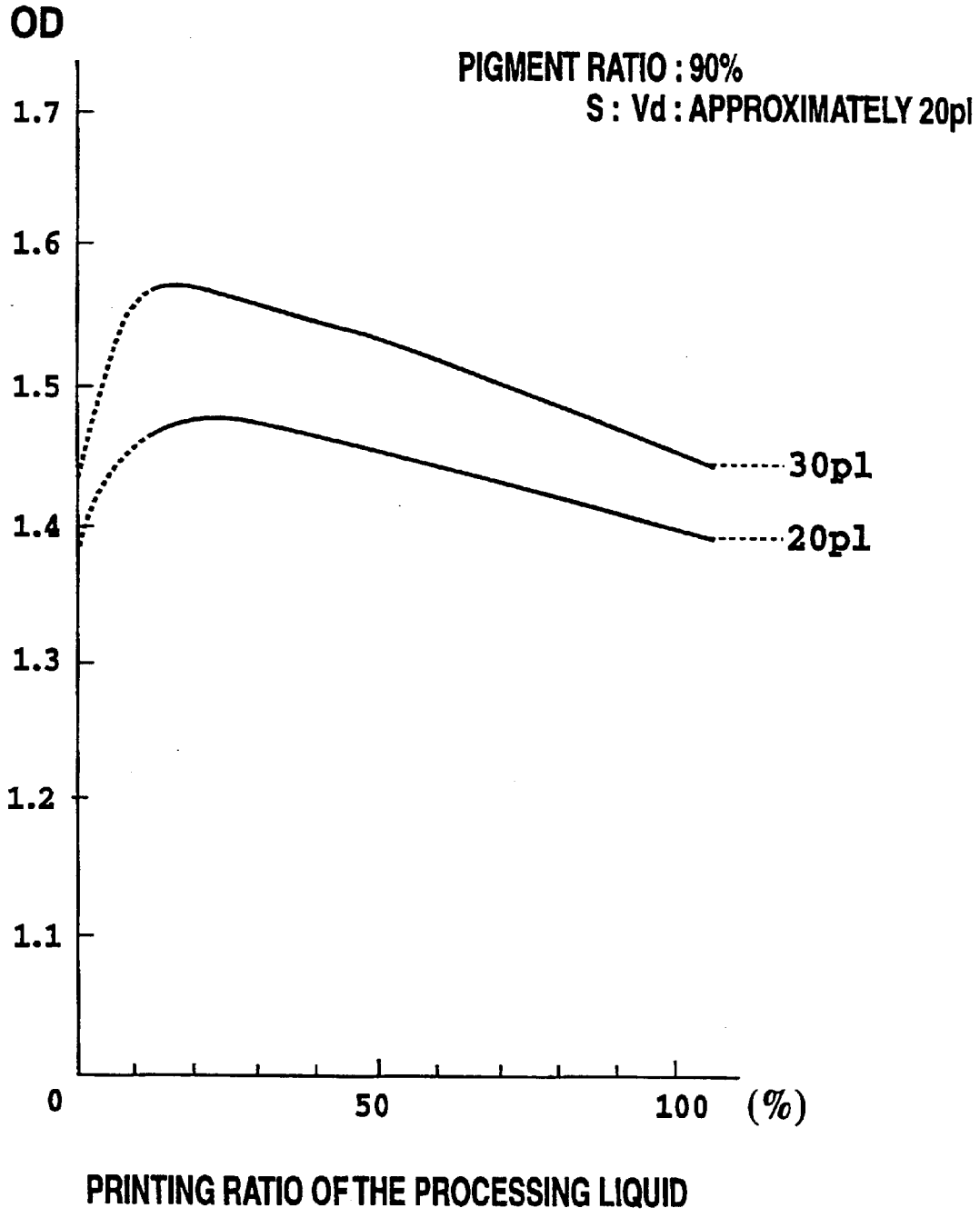
FIG. 5 is a graph showing the relationship between OD and printing ratio of the processing liquid according to still another embodiment of the present invention.
Figure 6:
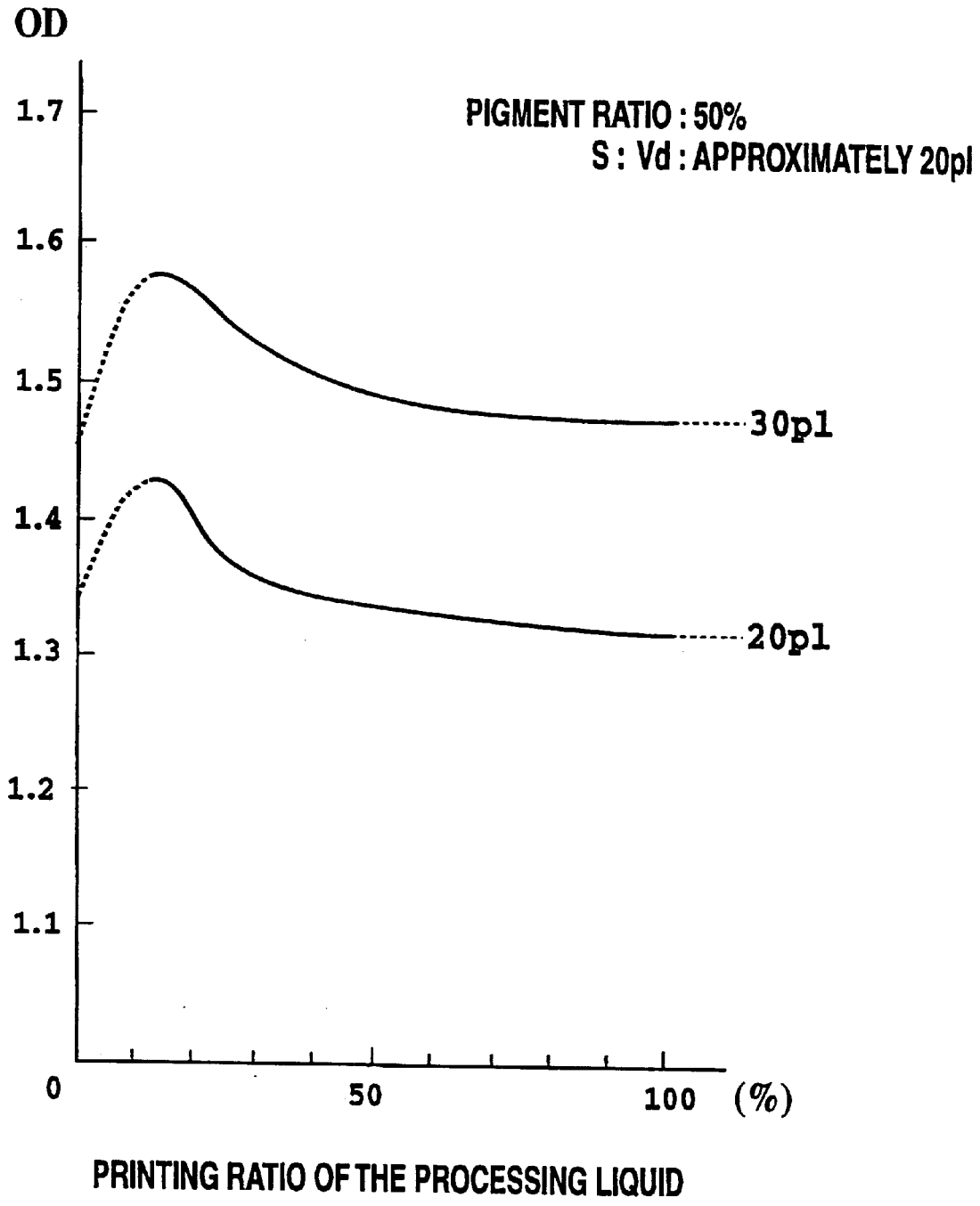
FIG. 6 is a graph showing the relationship between OD and printing ratio of the processing liquid according to still another embodiment of the present invention.

Experimental Example 3 investigates a relationship between OD and the printing ratio of the processing liquid in varying a pigment ratio of the colorant (ratio of the pigment to the total quantity of the pigment and dye) and an ejection amount of the ink. FIGS. 4, 5 and 6 show the relationships at a pigment ratio of 100% (no dye was used), 90% and 50%, respectively, where the pigment is free of the dispersant, as is the case with Experimental Example 1.

These results also generally indicate the trend, as considered in FIG. 1, that OD increases as printing ratio decreases to a certain level, similar to those observed in Experimental Examples 1 and 2.

Figure 7:
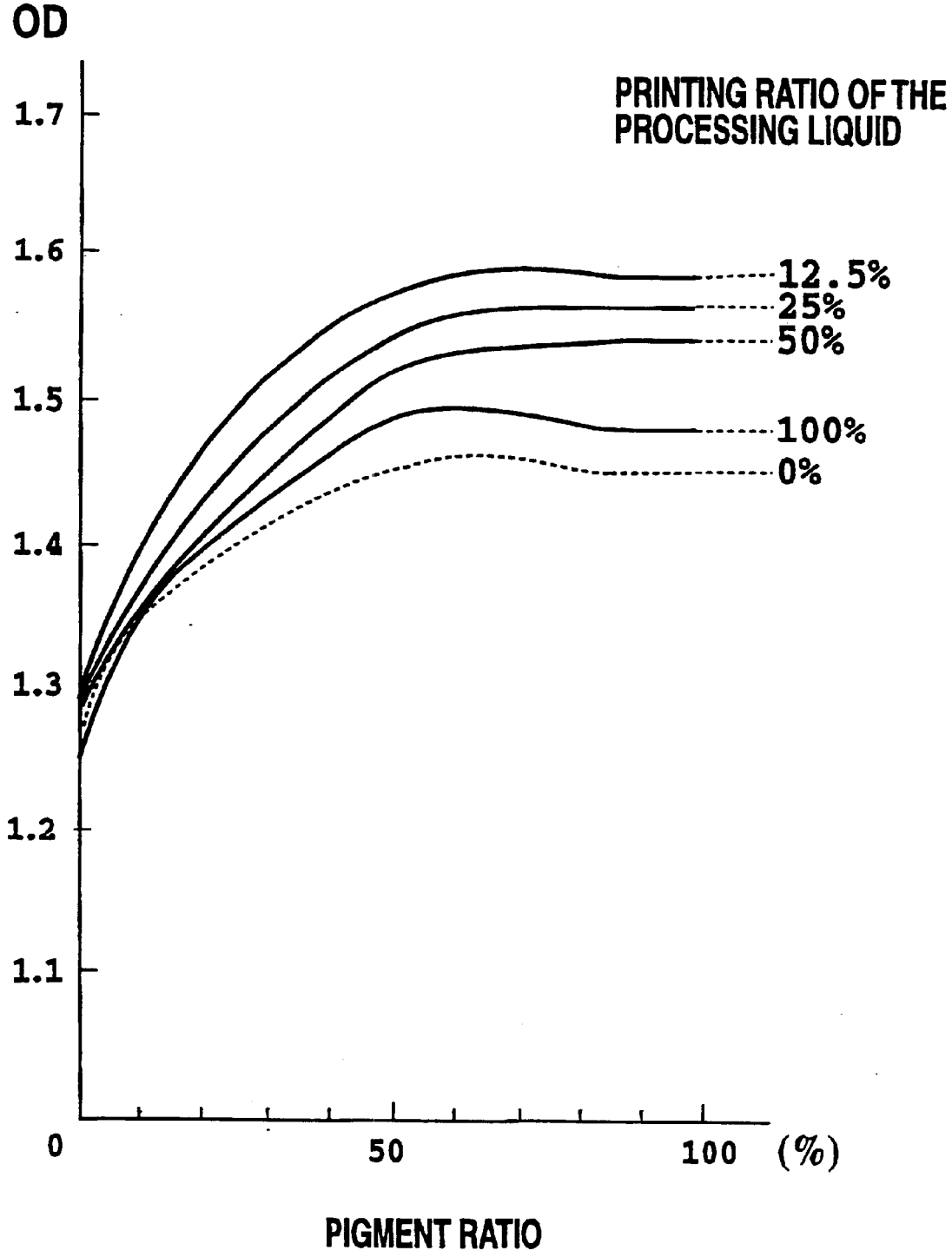
FIG. 7 is a graph showing the relationship between OD and pigment ratio according to one embodiment of the present invention.

FIG. 7 explains the results obtained by Experimental Examples 1 and 3 described above by showing the relationship between OD and the pigment ratio which is within the parameter of the printing ratio of the processing liquid. The result shown in the figure is one in the case that the ejection amount of the Bk ink is set at 30 pl.

The results shown in FIG. 7 indicate that OD becomes higher, when pigment ratio is 10% or more, than that of the image formed in the absence of the processing liquid (at the printing ratio of 0%, represented by the broken line).

OD increases as the printing ratio of the processing liquid decreases, as discussed above.

Figure 8:
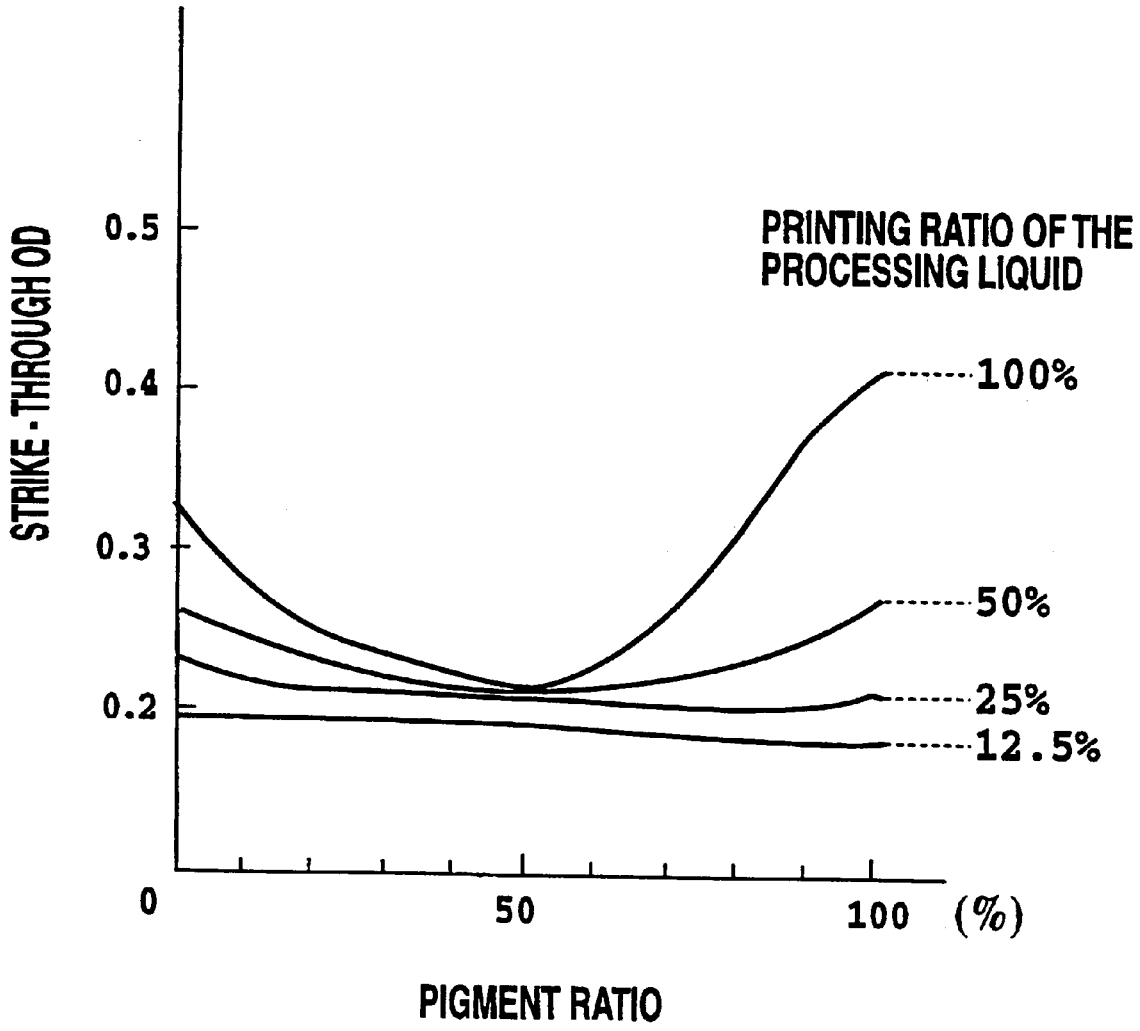
FIG. 8 is a graph showing the relationship between strike-through OD and pigment ratio according to one embodiment of the present invention.

FIG. 8 shows the relationship between strike-through OD and the pigment ratio for each of printing ratios of the processing liquid. The relationship represents the printing results observed in the above Experimental Examples, using the same print system as used for Experimental Examples 1 and 3, where the strike-through OD is observed from the back side of the printing medium. As shown, the strike-through OD is relatively high when the pigment ratio is 100% at a printing ratio of the processing liquid of 100% or 50%. It should be noted, however, the strike-through OD does not change irrespective of change of the pigment ratio and is low, when the printing ratio of the processing liquid is 25% or 12.5%.

It is considered, based on the results observed in Experimental Examples 1 to 3, that the preferred printing system of the embodiments of the present invention first applies the ink onto the printing medium, and then applies the processing liquid of relatively high penetrability and containing a polymer insolubilizer at a predetermined ratio to the ink. The predetermined printing ratio can be realized by sufficiently thinning out the processing liquid, for example, at the printing ratio of 12.5% at which the highest OD can be realized, because the strike-through OD is kept low at such printing ratio, as illustrated in FIG. 8. In other words, the strike-through OD can be kept low, irrespective of the pigment ratio at such a low printing ratio, as illustrated in FIG. 8. Therefore, the pigment ratio can be selected for specific purposes of the print system among various pigment ratios.

(Embodiment 2)

A second embodiment of the present invention switches the printing modes, while taking fixation time into consideration, in the above-mentioned basic printing system. More concretely, printing rate is switched in accordance with the ejection amount of the ink for each pixel and its fixation time.

Figure 9:
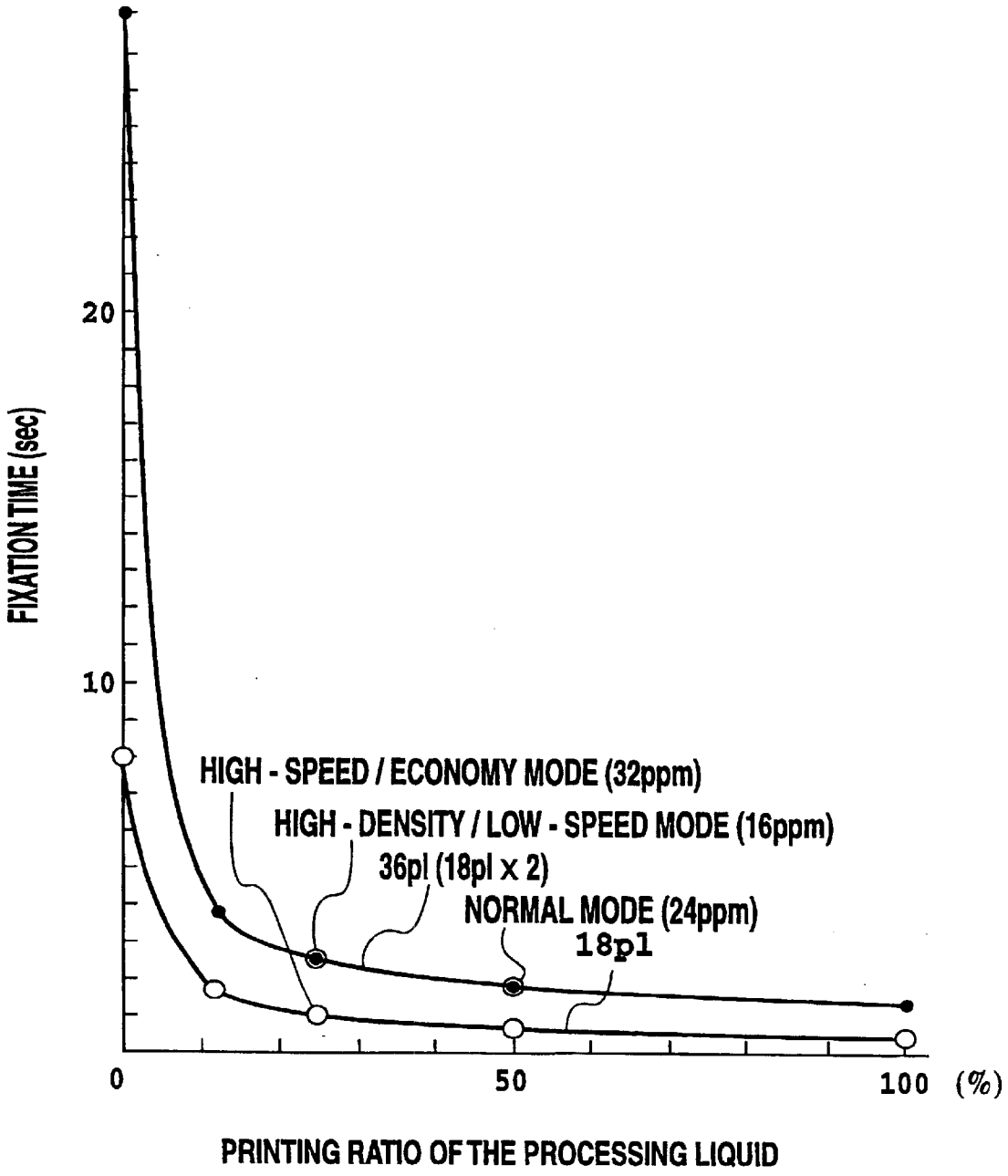
FIG. 9 is a graph showing the relationship between fixation time and printing ratio of the processing liquid according to another embodiment of the present invention.
Figure 10:
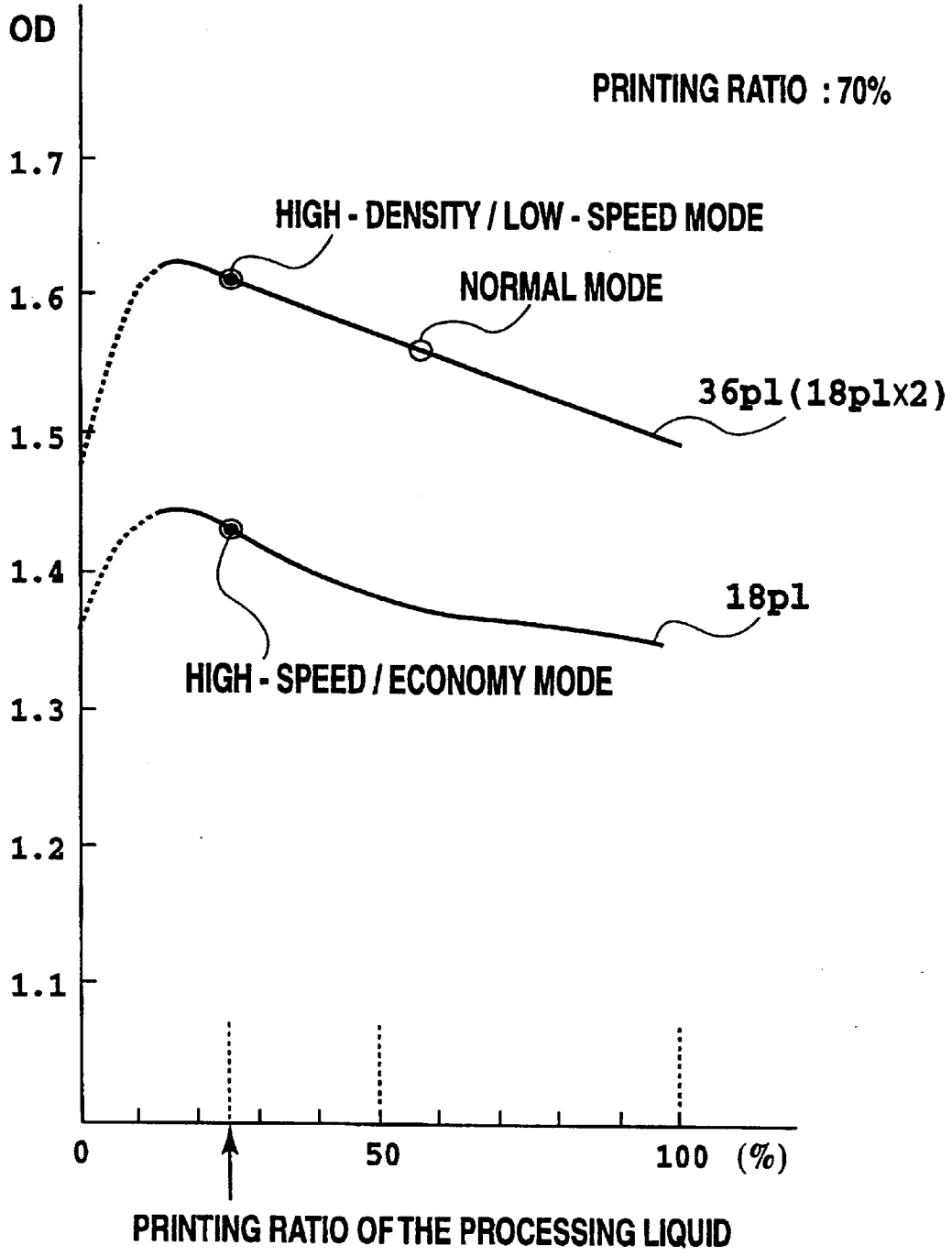
FIG. 10 is a graph showing the relationship between OD and printing ratio of the processing liquid according to still another embodiment of the present invention.

FIG. 9 shows a relationship between fixation time and a printing ratio of the processing liquid at ejection amounts of the Bk ink of 18 pl and 36 pl for each pixel having a pixel density of 600 dpi. FIG. 10 similarly shows a relationship between OD and a printing ratio of the processing liquid for two levels of Bk ink ejection amount.

The embodiment sets a printing mode by selecting conditions coping with a desired printing mode, from fixation time and the OD which change with changing of the printing ratio of the processing liquid, as shown by the results obtained by Experimental Examples and also by the results predicted therefrom. Three modes are set; normal, high-density/low-speed and high-speed/economy modes.

As shown in FIGS. 9 and 10, the normal mode applies a processing liquid at a printing ratio of 50%. At this ratio, fixation time is approximately 1.8 sec, allowing printing 24 sheets of A4-size paper per minute (24 ppm). The OD of the printed image will be relatively high at approximately 1.55 at the highest. The high-density/low-speed mode applies a processing liquid at printing ratio of 25%. In this case, fixation time is approximately 2.5 sec (16 ppm) to be a lower printing speed than the normal mode but higher OD at approximately 1.61. The high-speed/economy mode sets an ink ejection amount for each pixel reduced to half from that for the above modes to control ink consumption, sets a printing ratio of the processing liquid to be 25% to realize a relatively high OD at approximately 1.43, and increases fixation time to secure a high printing rate of 32 ppm.

The fixation time is measured as time until reflected light (the so-called brightness) from the liquid droplets on the printing medium surface disappears. It is confirmed to be a paper apply time interval at which the back side of a discharged paper is not stained with the ink on the paper applied immediately before, when a number of common paper sheets are continuously printed and applied from the printer.

The Bk ink for this embodiment contains a dispersant-free pigment as the colorant at a pigment ratio of 70%.

For a printer equipped with full-line type heads, the modes can be switched from one to another by changing a conveying rate at which the printing medium is conveyed, and changing driving frequencies, at each of which the printing heads for the Bk ink and the processing liquid are driven, in accordance with the changed medium conveying rate. This secures the Bk ink and the processing liquid to be applied to the pixels of 600 dpi for this embodiment.

The printing modes are operated under the following conditions.

Normal Mode

Quantity of the Bk ink: Two droplets each having an amount of 18 pl/droplet are ejected for each one pixel.

Quantity of the processing liquid: One droplet having an amount of 18 pl/droplet is applied for every two pixels, because its printing ratio is set at 50%.

Driving frequency is set at 6 kHz for respective printing heads, and a medium conveying rate is set at 127 mm/sec.

High-concentration/low-speed Mode

Quantity of the Bk ink: The same as that for the normal mode.

Quantity of the processing liquid: One droplet having an amount of 18 pl/droplet is applied for every four pixels, because its printing ratio is set at 25%. Driving frequency is set at 4 kHz for respective printing heads, and the printing medium conveying rate is set at 85 mm/sec.

High-speed/economy Mode

Quantity of the Bk ink: One droplet having an amount of 18 pl/droplet is applied for each one pixel.

Quantity of the processing liquid: One droplet having an amount of 18 pl/droplet is applied for every four pixels, because its printing ratio is set at 25%.

Driving frequency is set at 4 kHz for respective printing heads, and printing medium conveying rate is set at 170 mm/sec.

Of these printing modes, the high-speed/economy mode has an approximately 1.3 times higher printing rate (the medium conveying rate) than the normal mode. The high-speed/economy mode, being operated at a lower driving frequency, shows better ejection stability, because, e.g., the ink is refilled sufficiently. Further, the Bk ink consumption in this mode is half that of the normal mode, and so is the processing liquid consumption. Nevertheless, however, this mode gives a sufficiently high OD level of 1.43.

Table 1 summarizes the operating conditions, OD and other characteristics of these modes.

TABLE 1

| Modes | High-density/ low-speed mode | Normal mode | High-speed/ economy mode |
|---|---|---|---|
| Number of the Bk ink ejected for each one pixel | 2 | 1 | 1 |
| Amount of the Bk ink (pl) ejected for each pixel of 600 dpi | 36 | 36 | 18 |
| Printing ratio of the processing liquid (%) | 25 | 50 | 25 |
| Highest OD attained | 1.61 | 1.55 | 1.43 |
| Fixating time (sec) | 2.5 | 1.8 | 1.0 |
| Printing rate (ppm) | 16 | 24 | 32 |

More concrete examples will be described than the above first and second preferred embodiments.

Figure 11:
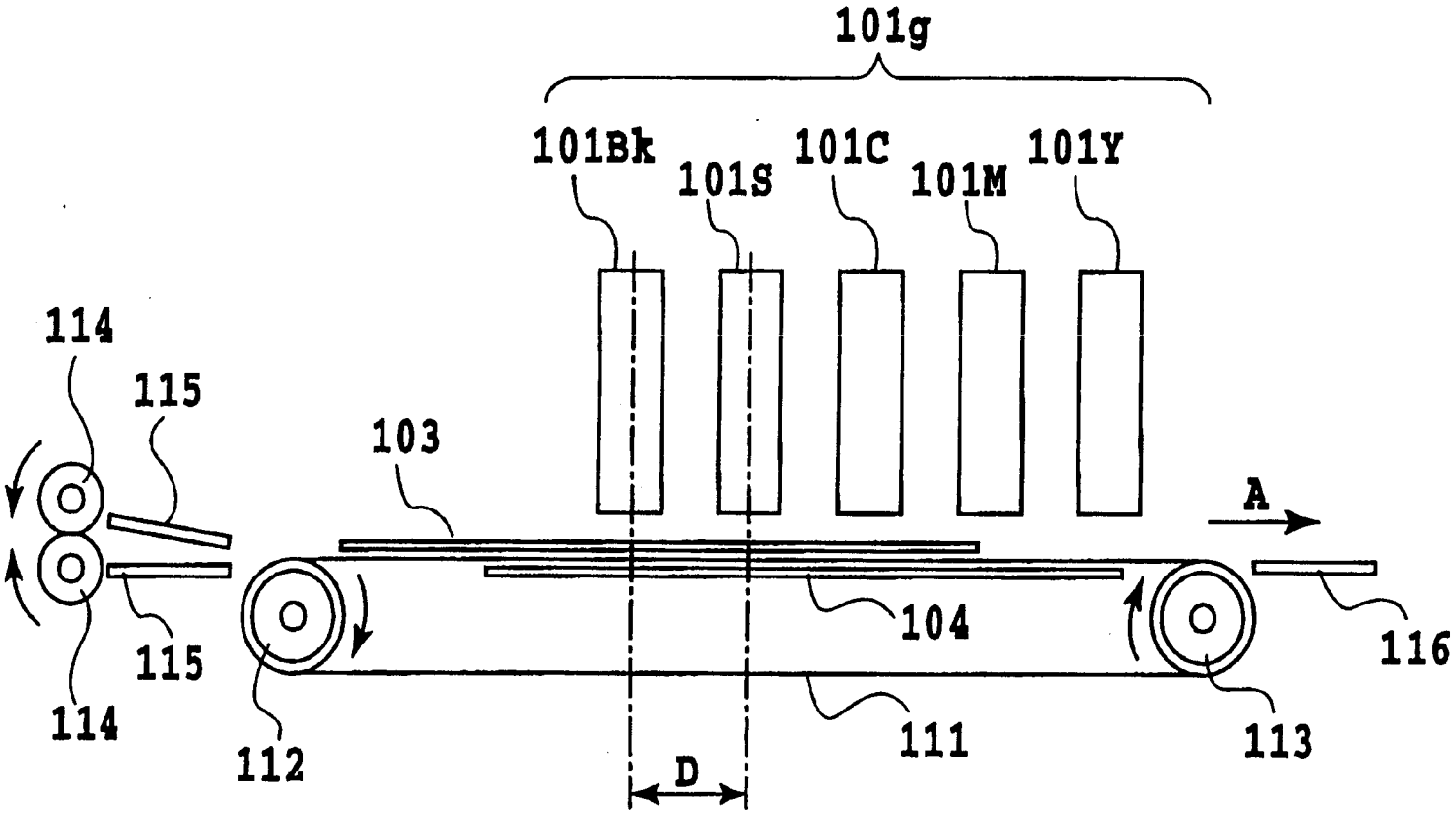
FIG. 11 is a side view showing a schematic configuration of a printer according to one example of the present invention.

FIG. 11 is a view generally showing a structure of a full-line type printer according to one example of the present invention.

The printer 1 adopts an ink printing method where a plurality of full-line type printing heads are arranged along a printing medium conveyed direction (shown by arrow A in the figure) and eject an ink or processing liquid to perform printing. Such printing operations are controlled by a control circuit (not shown).

Printing heads 101Bk, 101S, 101C, 101M and 101Y, which make up a head group 101*g*, are respectively equipped with approximately 7200 ink ejection ports arranged in a width direction (perpendicular to the paper on which the figure is shown) of the printing medium conveyed in the arrow A direction to be capable of printing A3-size medium at the largest.

The printing paper 103 is conveyed in the arrow A direction by a pair of resist rolls 114 driven by a conveying motor and guided by a pair of guide plates 115 to take registration alignment of a top end of the printing paper, and conveyed by the conveying belt 111. The endless conveying belt 111 is supported by two rollers 112 and 113, and the vertical motion of the upper side of the belt is limited by a platen 104. The printing paper 103 is conveyed upon rotation driving of the roll 113, where the printing paper adheres to the belt 111 by means of electrostatic force. The rotation driving of the roller 113 is performed by a driving source, e.g., motor (which is not shown) so as to convey the printing paper 103 in the arrow A direction. The printing paper 103 is subjected to printing by means of the head group 101*g*, while the printing paper is conveyed with the conveying belt 111, and then discharged onto a stacker 116.

Each print head in the head group 101*g* generates a bubble in the ink or processing liquid by utilizing thermal energy to eject the ink or processing liquid by a pressure the bubble provides. The printer is equipped with the heads 101S and 101Bk ejecting the processing liquid and black (Bk) ink, respectively, described in the above embodiments. It is also equipped with the heads for color inks (101C for cyan, 101M for magenta and 101Y for yellow). These heads are arranged in the direction A in which the printing paper 103 is conveyed, as shown in FIG. 11. These printing heads eject color inks and the processing liquid thinned out at a given rate, to print black and color images.

In this example, ink having a characteristic of low penetration speed (hereinafter referred to as up remaining ink in this example) is used as the black ink ejected from the head 101Bk. On the other hand, as the processing liquid or respective color cyan, magenta, and yellow inks which are respectively ejected from heads 101S, 101C, 101M and 101Y, the liquid or ink of higher in penetration speed (hereinafter referred to as penetrative inks in this example) is used.

The penetration speed will be described below.

It is known that when penetrability of the processing liquid and ink (hereinafter referred to simply as liquid) is represented by e.g. a penetrated liquid amount V per 1 $m^2$, the penetrated liquid amount V ($ml/m^2=\mu m$) is expressed by Bristow equation as a function of time (t) elapsing after a liquid droplet is ejected.

$$V=Vr+Ka(t-tw)^{1/2}$$

where, Lt>tw.

The liquid droplet is mostly absorbed by the irregularities on the printing paper (roughened portion on the paper), immediately after it lands on the paper, few penetrating inward. This time span for the absorption is represented by tw (wet time), and quantity of the liquid absorbed by the surface irregularities by Vr. When time (t) after the droplets reach also the paper exceeds the time tw, the penetrated liquid hereinafter referred to as amount V increases in proportion to ½th order, hereinafter also referred to as the square root, of the exceeded time span (t−tw). Ka is a proportional coefficient of increasing of the penetrated liquid amount, varying with the penetration speed of the liquid. It is hereinafter referred to as penetration coefficient.

Figure 12:
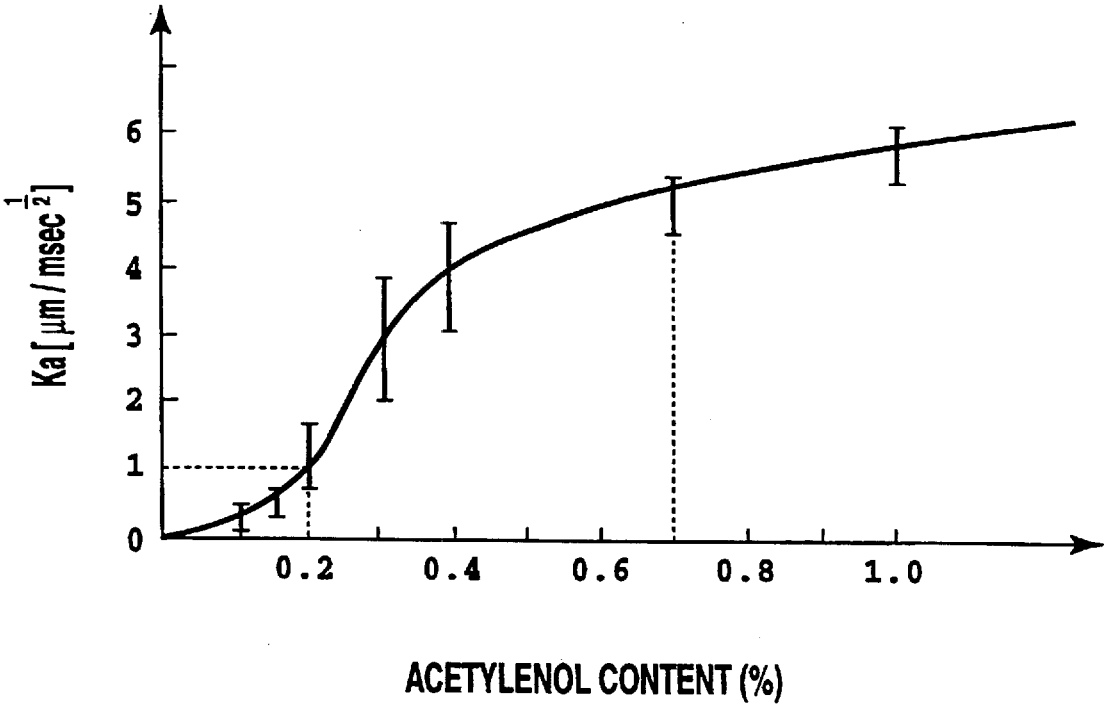
FIG. 12 is a graph showing the relationship between Ka value representing penetrability and acetylenol content for the above example.

FIG. 12 shows an empirical relationship between the penetration coefficient Ka and acetylenol content in the liquid.

The Ka value is measured by a dynamic liquid penetrability tester S (manufactured by Toyo Seiki Seisaku-sho, Ltd.), based on Bristow method. The printing paper used in this test was PB paper (produced by Canon Inc. as the assignee of the present invention), which can be used for printing both by an electrographic device (e.g., a copy machine and laser beam printer) and an ink-jet printer.

Similar results are observed for PPC paper (also produced by Canon Inc.).

As shown in FIG. 12, a curved line shows that the Ka value (the ordinate axis) increases as the acetylenol content (the abscissa axis) increases and the former is determined by the latter, by which is meant that penetration speed of the ink (liquid) is essentially determined by its acetylenol content. The short lines crossing the curved line and parallel to the ordinate axis in the figure represent fluctuation ranges of the experimental data.

Figure 13A:
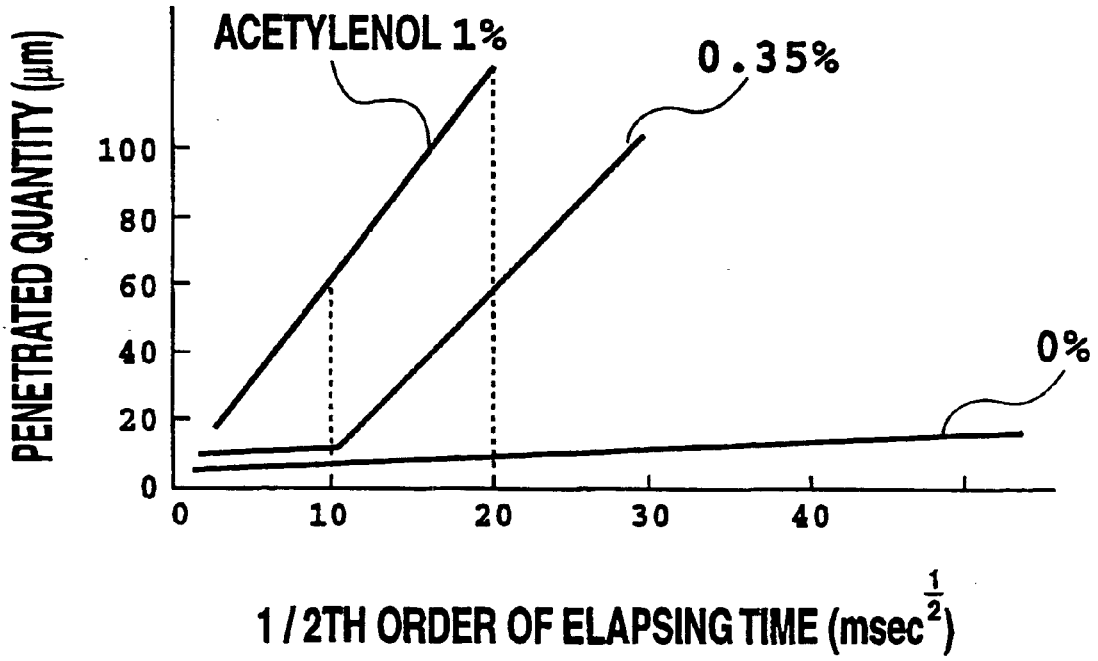
FIGS. 13A and 13B are graphs showing the respective relationship between penetration rate and time after the ink reaches the printing medium, with acetylenol content as the parameter representing penetrability.
Figure 13B:
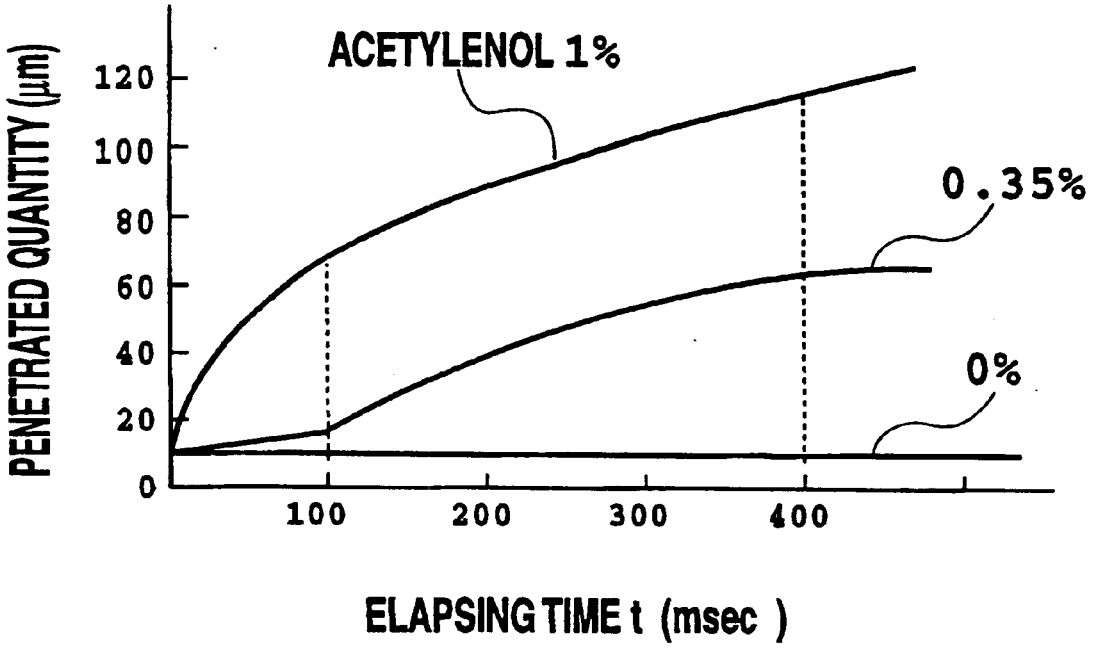

FIGS. 13A and 13B show a relationship between the penetrated liquid amount and the time after the ink reaches the printing paper, and showing a result obtained by an experiment where the printing paper (PB paper) has a weight of 64 $g/m^2$, thickness of approximately 80 $\mu$m and void volume of approximately 50%.

The abscissa axis in FIG. 13A represents the square root of the elapsing time (t) ($msec^{1/2}$), where the abscissa in FIG. 13B represents the elapsing time (t) (msec). The ordinate axis in these figures represents the penetrated liquid amount V ($\mu$m). These figures show curved lines for respective acetylenol content 0%, 0.35% and 1% as parameters.

As apparent from these figures, the penetrated liquid amount at a given elapsing time increases and the liquid becomes more penetrative as the acetylenol content increases. Also, these figures show general trends that the wet time (tw) decreases as the acetylenol content increases and penetrability also increases as the acetylenol content increases even if the elapsing time does not reach the wet time.

The liquid free of the acetylenol (acetylenol content is 0%) is low in penetrability and has a character of the up remaining ink, defined later. On the other hand, the liquid containing 1% of acetylenol quickly penetrates into the printing paper 103 and has a character of the penetrative ink, also defined later. The liquid containing 0.35% of acetylenol has a character intermediate between the two (semi-penetrative ink).

Table 2 summarizes the characteristics or definitions of the up remaining ink(liquid), penetrative ink(liquid) and semi-penetrative ink(liquid).

TABLE 2

| | Ka value ($ml/m^2\ msec^{1/2}$) | Acetylenol content (%) | Surface tension (dyne/cm) |
|---|---|---|---|
| Up remaining ink | Less than 1.0 | Less than 0.2 | 40 or more |
| Semi-penetrative ink | 1.0 or more but less than 5.0 | 0.2 or more but less than 0.7 | 35 or more but less than 40 |
| Penetrative ink | 5.0 or more | 0.7 or more | Less than 35 |

Table 2 shows the Ka value, the acetylenol content (%) and surface tension (dyne/cm) of the up remaining, semi-penetrative and penetrative liquids, used as the ink or processing liquid. Penetrability of these liquids into the printing paper as the printing medium increases as the Ka value increases. In other words, it increases as surface tension decreases.

The Ka value shown in Table 2 was measured by a dynamic liquid penetrability tester S (manufactured by Toyo Seiki Seisaku-sho, Ltd.), based on the Bristow method. The printing paper used in this test was PB paper (produced by Canon Inc. as the assignee of the present invention). The similar results were observed with PPC paper (also produced by Canon Inc.).

Critical micelle concentration (CMC) of a surfactant in a liquid is known to be one of conditions under which the surfactant is dissolved in the liquid. This concentration is the critical level at which a number of molecules are rapidly associated each other to form a micelle when concentration of a surfactant-containing solution increases. Acetylenol used to adjust penetrability of the liquid is one type of the surfactant and should similarly have the critical micelle concentration according to the liquid.

As characteristics of a relationship between surface tension and the acetylenol content, it is known that surface tension of a liquid no longer decreases when its acetylenol content increases to begin to form the micelle. From this, it is confirmed that critical micelle concentration (CMC) of acetylenol for a water is approximately 0.7%.

When the penetrative processing liquid is transparent and difficult to measure the Ka value by Bristow method, it may be incorporated with 0.1% to 0.3% or so of a colorant having the same polarity as that of the reactive group in the solution to facilitate measurement of its Ka value. Addition of the colorant facilitates the measurement, because its addition rate little changes inhibition of the solution.

The liquids shown in Table 2 are viewed from critical micelle concentration (CMC). Taking the penetrative ink as an example, it contains acetylenol at a content higher than its CMC with water.

The processing liquid and inks for this example had following compositions, where content of each component is shown by weight parts.

| | |
|---|---|
| [Processing liquid] | |
| Glycerin | 7 parts |
| Diethylene glycol | 5 parts |
| Acetylenol EH (manufactured by Kawaken Fine Chemicals Co.. Ltd.) | 3 parts |
| Polyaryl amine (molecular weight: 1500 or less, average molecular weight: approximately 1000) | 4 parts |
| Acetic acid | 4 parts |
| Benzalkonium chloride | 0.5 parts |
| Triethylene glycol monobutyl ether | 3 parts |
| Water | Balance |
| [Yellow (Y) Ink] | |
| C.I. direct yellow 86 | 3 parts |
| Glycerin | 5 parts |
| Diethylene glycol | 5 parts |
| Acetylenol EH (manufactured by Kawaken Fine Chemicals Co.. Ltd.) | 1 part |
| Water | Balance |
| [Magenta (M) Ink] | |
| C.I. acid red 289 | 3 parts |
| Glycerin | 5 parts |
| Diethylene glycol | 5 parts |
| Acetylenol EH (manufactured by Kawaken Fine Chemicals Co., Ltd.) | 1 part |
| Water | Balance |
| [Cyan (C) Ink] | |
| C.I. direct blue 199 | 3 parts |
| Glycerin | 5 parts |
| Diethylene glycol | 5 parts |
| Acetylenol EH (manufactured by Kawaken Fine Chemicals Co., Ltd.) | 1 part |
| Water | Balance |
| [Black (Bk) Ink] | |
| Pigment dispersant solution | 35 parts |
| Food black 2 at a pigment ratio of 50% When pigment ratio is 100%, 10 wt.% of the pigment dispersant solution content is 50 parts. and when pigment ratio is 0% (dye is the sole colorant), food black 2 content is 4 parts. | 1.2 parts |
| Glycerin | 6 parts |
| Triethylene glycol | 5 parts |
| Acetylenol EH (manufactured by Kawaken Fine Chemicals Co., Ltd.) | 0.2 part |
| Water | Balance |

The pigment dispersant solution is described below:

[Pigment Dispersant Solution]

Concentrated hydrochloric acid (5 g of hydrogen chloride dissolved in 5.3 g of water) is incorporated with 1.58 g of anthranilic acid at 5° C. This solution is agitated in an ice bath to be kept at 10° C. or less, and incorporated with a solution comprising 1.78 g of sodium nitrite dissolved in 8.7 g of water at 5° C. The solution is further agitated for 15 min, to which 20 g of as-mixed carbon black (specific surface area: 320 $m^2/g$, and DBP oil absorptivity: 120 ml/100 g) is added. The mixture is further agitated for 15 min, and the resultant slurry is filtered by Filter No. 2 (manufactured by Toyo Roshi Kaisha, Ltd. of Advantec Group). Then, the pigment particles are sufficiently washed with water, dried at 110° C. in an oven, and then mixed with water to prepare a 10 wt. % aqueous solution of the pigment. The pigment dispersant solution 3 thus prepared is dispersed with self-dispersing type carbon black, anionically charged with the hydrophilic group bonded to the carbon black particle surfaces via phenyl group.

[Chemical Formula 1]

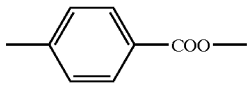

As indicated by the above compositions, the Bk ink is set as the up remaining ink, and the processing liquid and C, M and Y inks as the penetrative inks, according to their acetylenol contents.

The black ink uses a dispersant-free pigment, i.e., contains no dispersant, as described In the above embodiments. This ink suitably uses self-dispersing type carbon black of anionic, in which at least one type of hydrophilic group is bonded to the carbon black particle surfaces directly or via another type of atomic group. The self-dispersing type carbon black is preferably ionic, more preferably anionically charged.

The examples of anionically charged carbon black types have a surface-bonded hydrophilic group, such as —COOM, $—SO_3M$, $—PO_3HM$, $—PO_3M_2$, $—SO_2NH_2$, or $—SO_2NHCOR$ (M is hydrogen, an alkaline metal, ammonium or organic ammonium; and R is an alkyl, phenyl which may be substituted or naphtyl which may be substituted, having a carbon number of 1 to 12). The particularly suitable carbon black types for this example are anionically charged ones, with —COOM or $—SO_3M$ bonded to the carbon black particle surfaces.

The alkaline metal M in the hydrophilic group includes lithium, sodium and potassium, and the organic ammonium includes mono- and tri-methylammonium, mono- and tri-ethylammonium, and mono- and tri-methanolammonium. The anionically charged carbon black may be obtained by introducing —COONa to the carbon black particle surfaces, e.g., by oxidation-treating carbon black with sodium hypochlorite. It is needless to say that the method is not limited to the above.

It is preferable for the present example to use carbon black with a hydrophilic group bonded to the particle surfaces via another atomic group. Such atomic groups include an alkyl group, phenyl group which may be substituted and naphtyl group which may be substituted, having a carbon number of 1 to 12. The hydrophilic groups bonded to carbon black particle surfaces via another atomic group include, in addition to the above, $—C_2H_4COOM$, $—PhSO_3M$ and —PhCOOM (Ph is phenyl group), although not limited thereto, needless to say.

The carbon black as the dispersant-free pigment is itself more dispersible in water than the conventional carbon black, thus dispensing with pigment-dispersed resin or surfactant. This brings about various advantages, e.g., higher in adhesion and wettability than the conventional one, and hence excellent in reliability when handled by a printing head.

In this example, the ink ejection ports of each printing head are arranged at a density of 600 dpi, and printing is performed at a dot density of 600 dpi in the printing paper conveying direction. As a result, the image or the like printed in this example has a dot density of 600 dpi both in row and column directions. Further, each head ejects the liquid at a frequency of 4 kHz. Accordingly, the printing paper is conveyed at a rate of approximately 170 mm/sec. The Bk ink head 101Bk is 40 mm apart from the processing liquid head 101S (distance D in FIG. 11), which translates into approximately 0.24 sec as time interval required for ejecting the Bk ink after the processing liquid.

Figure 14:
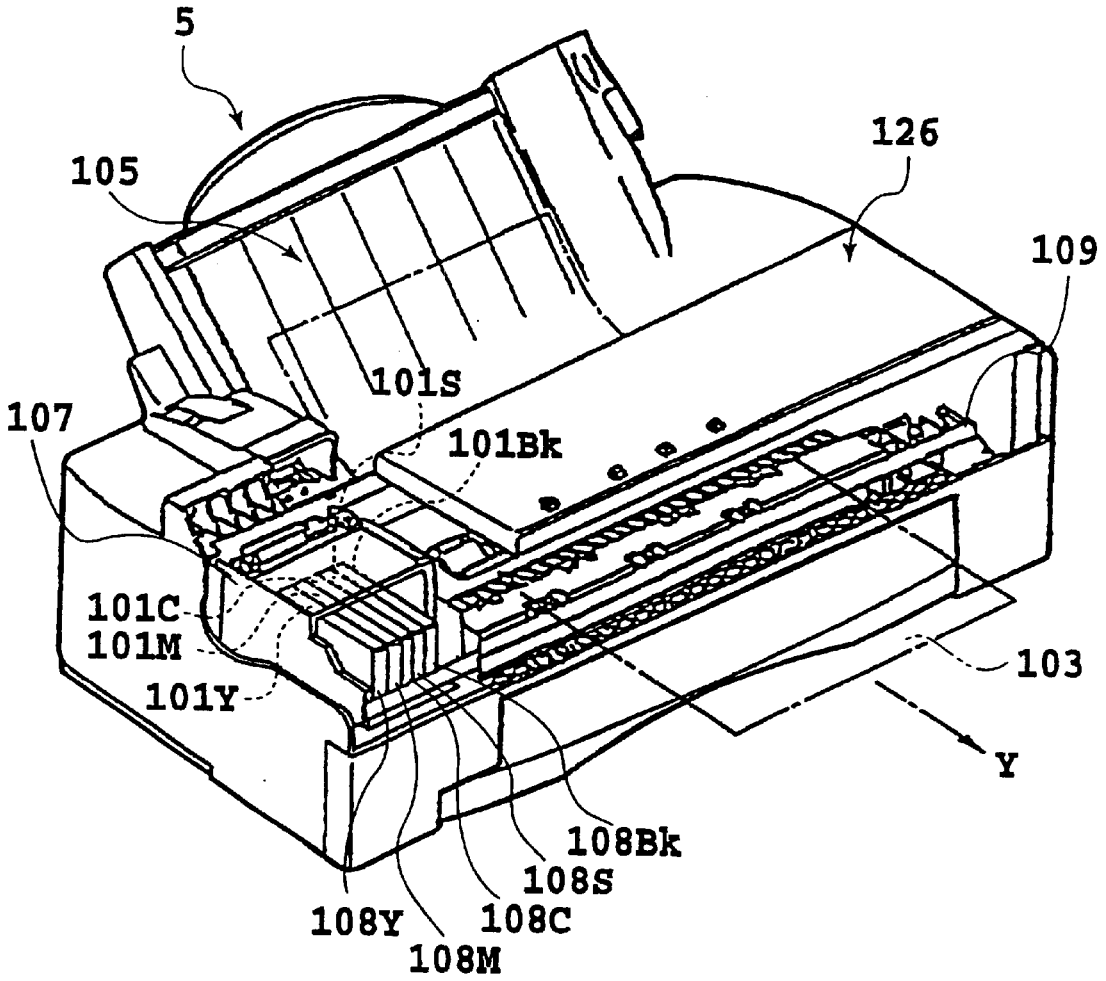
FIG. 14 is a perspective view of a serial printer according to another example of the present invention.

FIG. 14 is a perspective view showing an outline of a serial type printer 5 according to another example of the present invention. It is apparent that the printer which ejects the Bk ink to react it with the processing liquid ejected onto the printing medium before is applicable not only to the above-mentioned full-line type but also to a serial type. The same elements in FIG. 14 as those in FIG. 11 are marked with the same reference signs to omit the description.

The printing paper 103 as the printing medium is inserted into the printer at a paper supply section 105, moves through a printing section 126 and is discharged from the printer. This example uses common, inexpensive paper as the printing paper 103. A carriage 107 in the printing section 126 mounts printing heads 101S, 101Bk, 101C, 101M and 101Y and adapted to move in both directions along the guide rail 109 by means of a driving force of a motor (not shown). The printing head 101S can eject the processing liquid at a given thinned-out rate, as described in the above-mentioned embodiments. The printing heads 101Bk, 101C, 101M and 101Y are driven to eject the black, cyanide, magenta and yellow inks, respectively, in this order, onto the printing paper 103.

The processing liquid and inks are supplied for respective ink tanks 108Bk, 108S, 108C, 108M and 108Y. An electrothermal converting element (heater) is provided for each ejection port of the head and is subjected to supply of an electrical signal to generate thermal energy when the processing liquid or the ink is ejected. The thermal energy generates a bubble in the processing liquid or the ink to eject the processing liquid or the ink by means of pressure of the bubble. Each head is provided with a total of 64 ejection ports at a density of 360 dpi, which are arranged in almost parallel to conveying direction Y of the printing paper 103, or in the direction almost perpendicular to the head scanning direction. An ejection amount for each ejection port can be realized as the amount described in any one of the preceding embodiments.

The heads in this printer are ½ of an inch apart from each other. Accordingly, a distance between the heads 101S and 101Bk is ½ of an inch. Further, since a printing density of 720 dpi in the scanning direction and ejection frequency is 7.2 kHz at each head, the time interval required for ejecting the Bk ink from the head 101Bk after the processing liquid is ejected from the head 101*s* becomes 0.05 sec.

(Embodiment 3)

The preceding embodiments basically pursue high OD by thinning out only the processing liquid. On the other hand, high OD can be realized by decreasing printing ratio of the ink to thin out the ink dots, which will be described below.

This embodiment, aiming at high optical print density and reduced ink consumption, is applied to an ink-jet printer performing printing with the Bk ink.

Figure 15:
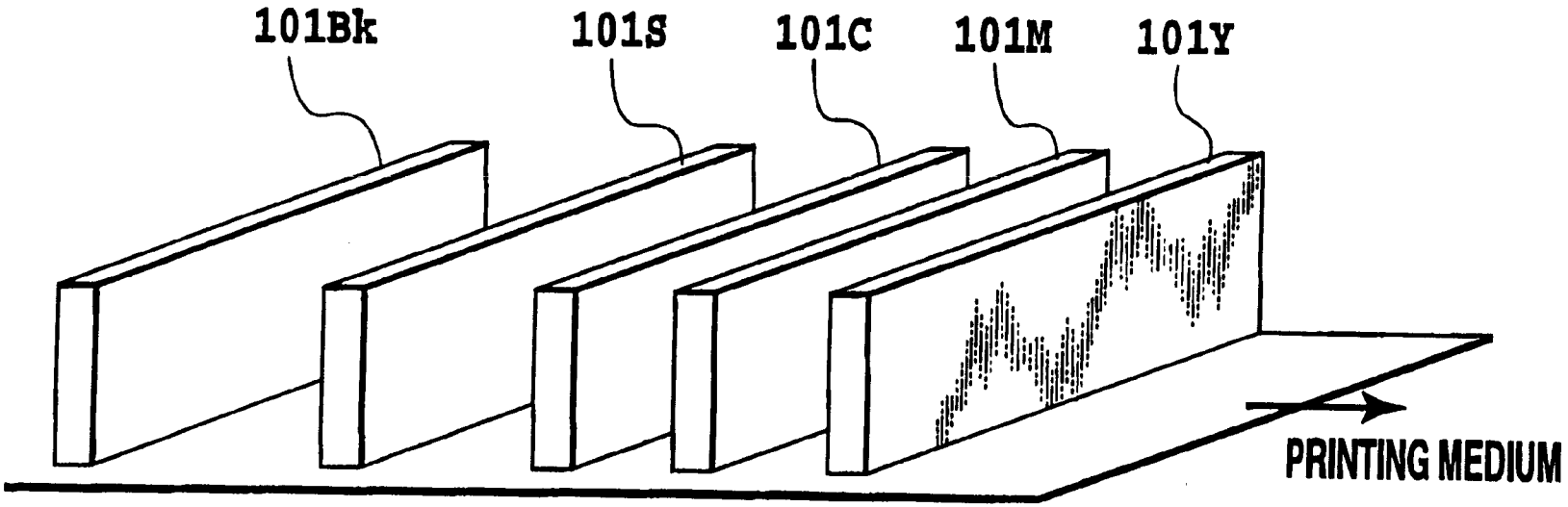
FIG. 15 is a view showing outlines the printer structure of still another embodiment according to the present invention.

FIG. 15 is an illustration illustrating an ink-jet printer of this embodiment. Heads 101Bk, 101S, 101C, 101M and 101Y respectively eject the processing liquid and the ink onto the printing medium while the printing medium is conveyed below the heads. The Bk ink contains a pigment as a colorant, for which the pigment may be used alone or in combination with a dye. Printing is performed with the Bk dots thinned out to reduce ink consumption. In thinning out of the dots, increasing distance between the dots decreases an area factor to lower the printing density.

Figure 16:
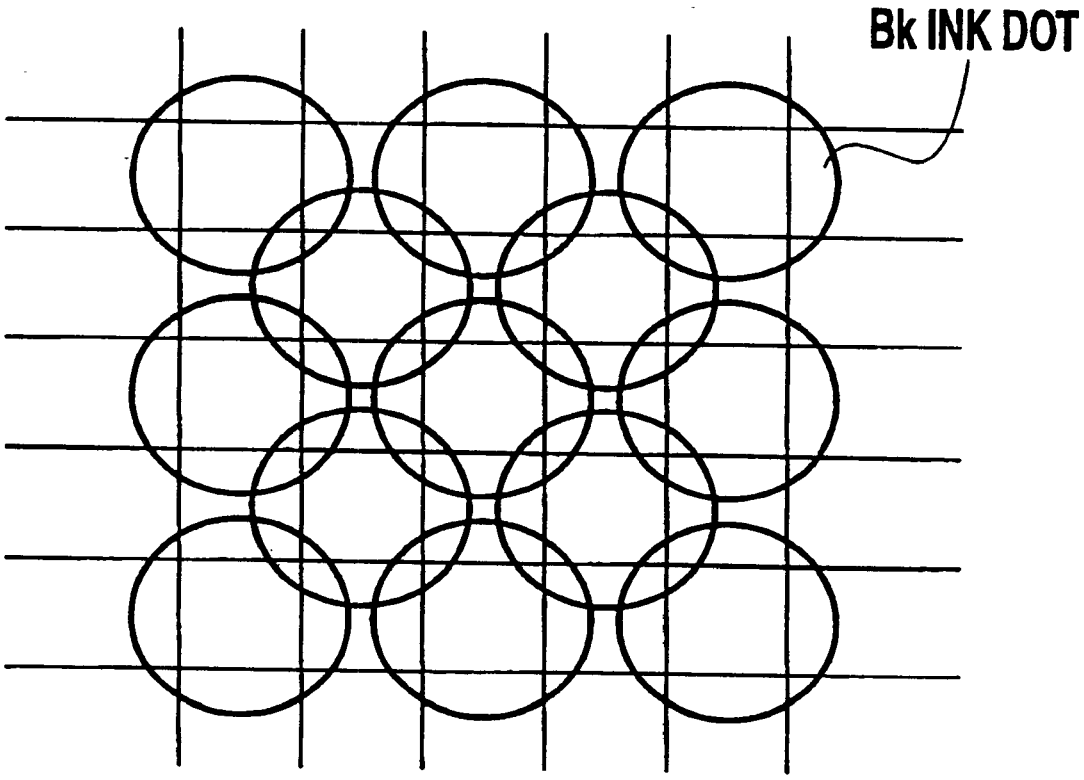
FIG. 16 is an illustration illustrating a printed image with a thinned-out black ink for still another embodiment of the present invention.

FIG. 16 is an illustration schematically showing a printed result when thinning the Bk ink dots at a rate of 50% using a checker pattern, where one unit sectioned with a lattice formed by lines represents one pixel and a circle represents the Bk ink dot. Normally, the ink is applied at an amount higher than that theoretically required to have a larger dot size for obtaining a high printing density, in consideration of a gap between the dots, which is caused by deflection of liquid droplet ejected to deviate its position on the paper and a dot size varying according to paper quality. Therefor, a circular dot will partly hang out of a square-of the pixel, when the former tries to completely fill the latter. As a result of this, decrease in the area factor will be moderate when thinning-out ratio of the Bk ink is limited to 50% or so. A given printing density can be mostly secured when the area factor is kept at near 100%. On the other hand, thinning-out the ink to a level to cause great decrease in the area factor should result in great decrease in the printing density. The critical dot thinning-out ratio below which decrease in the area factor is moderate varies depending on dot size, which varies with the ink ejection amount, printing resolution, a printing medium type, an environmental temperature and humidity or the like. In this embodiment, the ink thinning-out ratio is set to keep the area factor close to 100% under various conditions, e.g., the printing medium type, and the environmental conditions e.g., temperature and humidity.

When an ink runs excessively in a printing medium, it generally tends to spread over the medium surface and increase dot size. This tends to be accompanied by increased area factor and accelerated diffusion of the ink inward, reducing quantity of the ink colorant remaining in the shallow surface layer (approximately 20 $\mu$m thickness), which greatly contributes to the printing density. It is necessary to concentrate the colorant in the 20 $\mu$m thick surface layer while preventing it from diffusing deeper, in order to efficiently keep the printing density within a limited quantity of the ink.

The common paper may be normally printed with the so-called up remaining ink to concentrate the colorant in the vicinity of the printing medium surface. This effect is enhanced when the ink is combined with the processing liquid of low penetrability which interacts with the colorant through a reaction between cation and anion. The effect can be enhanced especially when the ink contains the pigment as the colorant, because it loses fluidity and tends to remain in the vicinity of the medium surface. However, fixation time increases when an up remaining type Bk ink is applied onto an up remaining type processing liquid on the printing medium. On the other hand, fixation time is reduced when the up remaining type Bk ink is applied onto the penetrative processing liquid on the printing medium, which, however, conversely decreases the printing density when the processing liquid is thinned out to 50% of the Bk ink apply rate, making it difficult to realize a desired level of ink saving.

The printing density will increase when the processing liquid is applied after applying the up remaining type Bk ink containing the pigment as the colorant, as discussed in the preceding embodiments. The penetrative processing liquid is used in order to increase fixing speed and promote the reaction between the processing liquid and the Bk ink colorant diffusing deep in the printing medium, where the processing liquid is applied in a thinned-out manner after applying the ink. Thinned out the penetrative processing liquid allows the processing liquid to diffuse more in the horizontal direction than in the vertical direction to reduce the gap between the dots caused by the thinning, and prevents the Bk ink from penetrating deep into the printing medium. The penetrative processing liquid is applied at a rate of thinned out to an extent similar to or less than that for the Bk ink, after the Bk ink is applied but before it diffuses deep into the printing medium. To fully realize this effect, penetrability of the Bk ink should be kept relatively low.

Applying the ink and then the highly penetrative processing liquid having a penetration coefficient Ka of 5.0 or more in the thinned-out manner realizes the high printing density, and hence is desirable. It is recommended to thin out the processing liquid to 1/2 to 1/9 of apply rate of the Bk ink, while keeping most of the ink in contact with the processing liquid.

Unevenness of the density at a solidly printed section resulting from, e.g., deflection of ejected droplets, i.e., fluctuation in formed dot positions, causes a local ratio of the Bk ink of low penetrability to the processing liquid of high penetrability. The fluctuation in formed dot positions causes rapidly and slowly penetrated parts locally, thus causing local penetration speed and ink colorant distribution. Thinning out the processing liquid uniformly in a pattern is preferable, because the processing liquid penetrates into the printing medium more uniformly. Accurately positioning the ink droplets is also an important consideration to position the dots accurately. The gap between the dots can be reduced by slightly increasing penetrability of the Bk ink in a range of the up remaining type; a penetration coefficient Ka<1.0, or by ejecting the Bk ink and processing liquid to reach the printing medium at longer intervals between them in such a way to keep the Bk ink concentrated in the approximately thicker than 20 mm surface layer.

Figure 17:
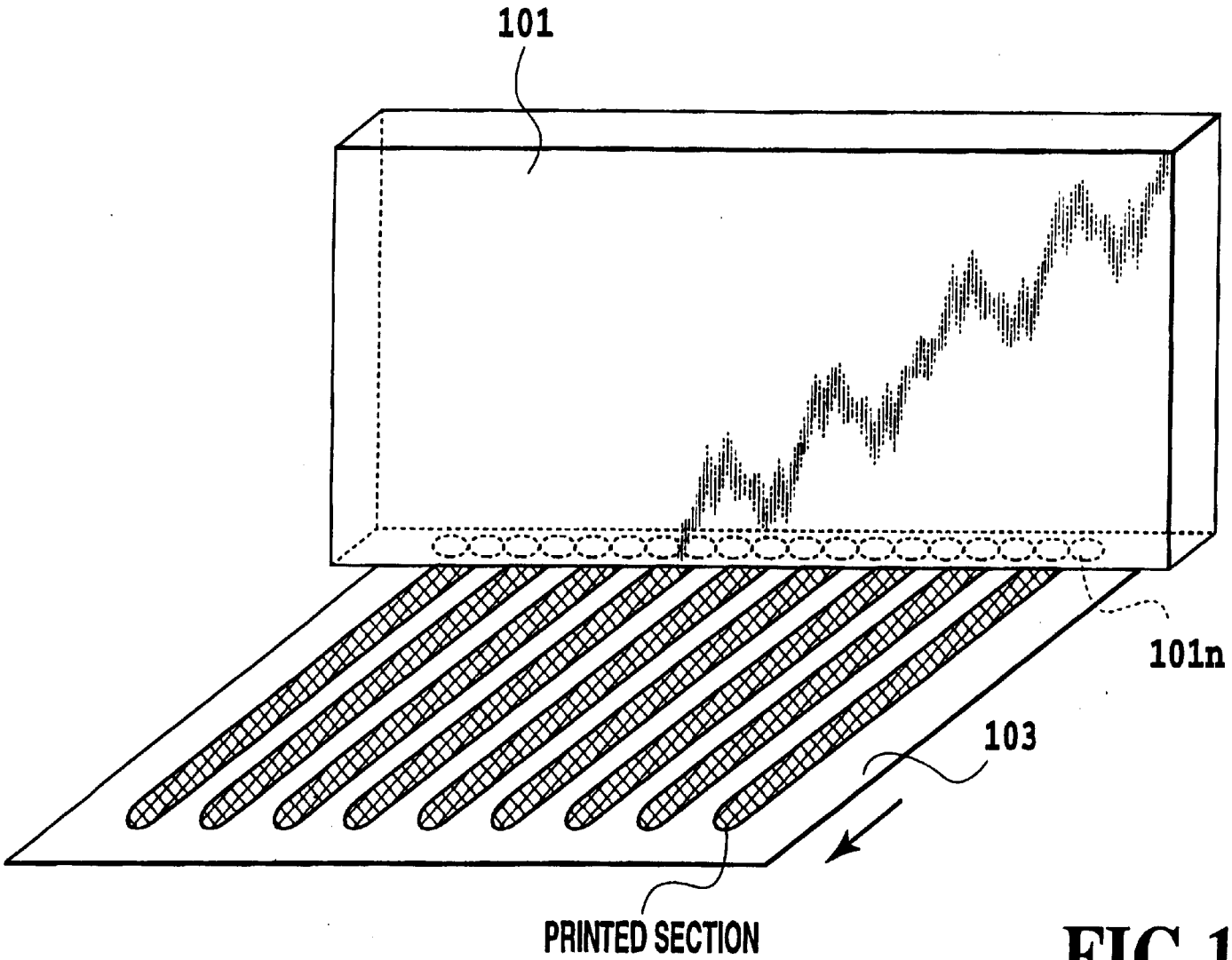
FIG. 17 is an illustration illustrating a printed image with a thinned-out ink according to still another embodiment of the present invention.
Figure 18:
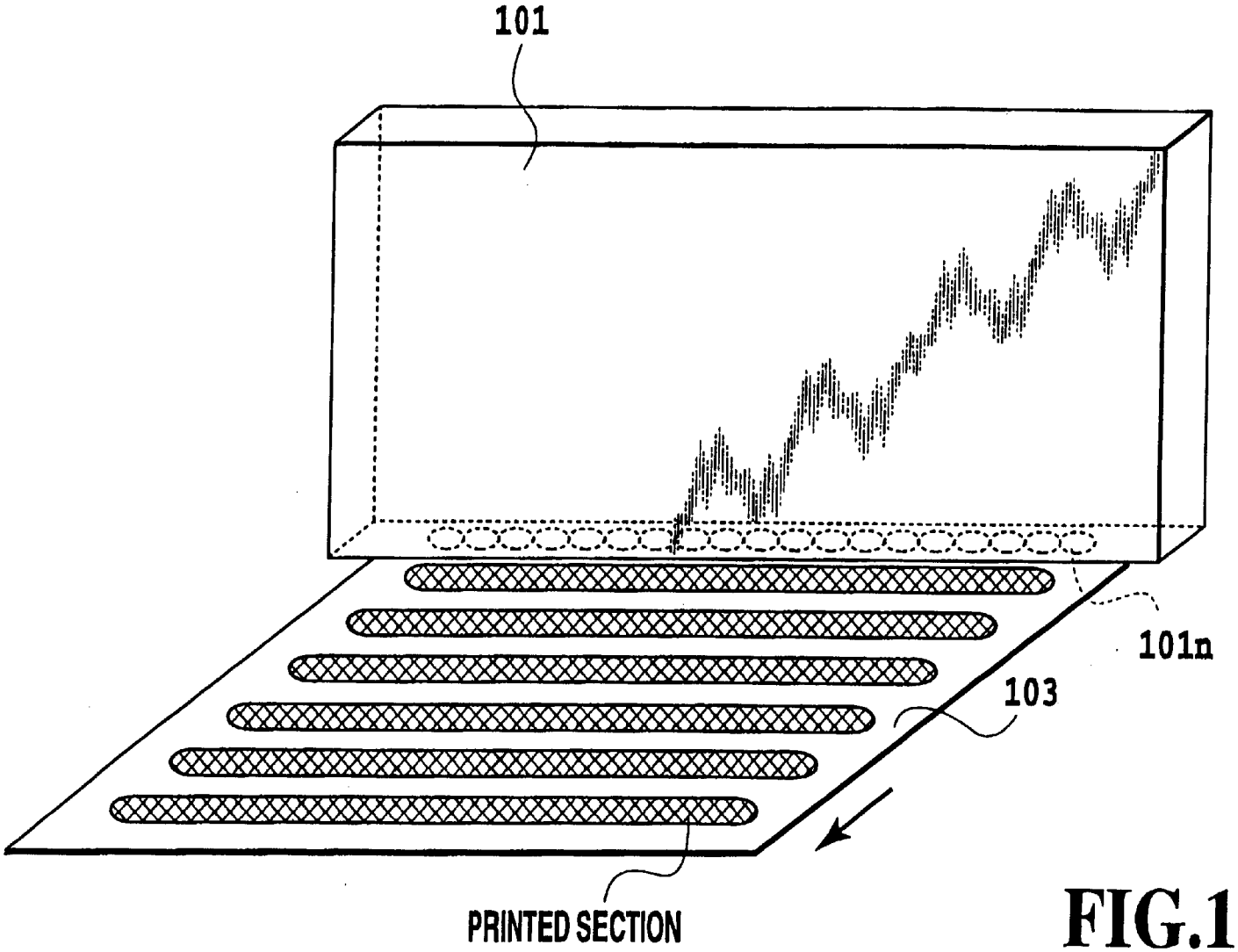
FIG. 18 is an illustration illustrating another example of printed image with a thinned-out ink.

The penetrability of the liquid is kept at an adequate level by controlling dose rate of an agent to accelerate penetration, e.g., surfactant, in order to realize desired rate of running of the liquid over the printing medium. A method of thinning out the liquid is known as binarization based on the pattern dither and the error diffusion, or as performing thinning of dot nozzle by nozzle or in the conveying direction of the printing medium. For example, the thinning-out ratio is halved when the liquid is applied at every other nozzle as shown in FIG. 17, or at every other dot in the printing medium conveying direction as shown in FIG. 18. Driving pulse may be modulated to change the ejection amount of the liquid so that thinning-out can be performed. The ejection amount stated above in a bubble-jet type printer can be changed by modulating a pre-pulse of a double pulse or switching the double pulse to a single one. In a piezoelectric type, the ejection amount can be changed by changing a meniscus position immediately before ejecting the liquid or changing rate of the piezoelectric device. When distribution of the processing liquid is uneven, running of the ink may be locally caused at an edge portion of the printed region to degrade its sharpness. In such a case, thinning-out of the processing liquid may be limited to the printed region inside rather than to the edges.

In order to realize ink saving and high printing density simultaneously for the above printer systems, an anionic carbon black pigment and anionic dye are used for the Bk ink colorant, the former being kept at a given content. The processing liquid is incorporated with a cationic polymer and cationic surfactant. For example, a Bk ink containing a pigment including a self dispersing carbon black at 30% or more of a black colorant and dye in a mixed state may be used to be applied onto the medium and then 100 msec later a highly penetrative processing liquid containing a cationic polymer and a small quantity of cationic surfactant is applied onto the Bk ink dots at a thinning-out ratio of 1/2 to 1/8. This gives a higher printing density than the case using no processing liquid, when the colorant for the Bk ink comprises a pigment and dye, the former containing at least 30% of a self-dispersing type carbon black pigment.

Another example of the present embodiment will be described. It is of a high-speed mode, i.e., printing at a higher speed than the normal printing mode, such as that described in Embodiment 2, with a Bk ink ejected at a thinned-out rate.

This example is made for separately providing high-speed printing mode in consideration of the phenomenon that the printing ratio decreases when performing the thinned-out printing. The normal mode is carried out so that the carriage or printing medium is driven at a frequency F calculated as a number of pixel per unit time, which is a frequency at which the printing head is driven. By contrast, the high-speed mode is carried out so that the carriage or the printing medium is driven at a frequency higher than F. For example, when the carriage or the printing medium is driven at a frequency twice as high as F, the printing ratio is halved. In other words, when the head is driven in the same manner as that for the normal mode, the printing medium is printed only on every other dot (pixel) in the conveying direction, as shown in FIG. 18. On the other hand, driving the head while shifting the phase by half on every other nozzle can realize checker patterned printing. Further, the upper limit of head driving frequency may be set by reasons other than those related to electrical systems, e.g., by ink refilling requirement. In such a case, frequency may be essentially doubled, when the driving circuit is operated to perform printing only by either the odd-number nozzle or the even-number nozzle and thus eject the liquid only by half the nozzles. When the carriage or printing medium is driven at the above frequency, the thinning-out printing by every other nozzle as shown in FIG. 17 can be effected faster. This thinning-out, when effected in a manner similar to that for Embodiment 3, can realize printing in a high-speed mode and ink saving simultaneously. This should not interfere head driving, because the processing liquid is thinned out at least to the same extent as is the Bk ink. However, it is relatively difficult to limit thinning-out to the printed region inside, rather than to the edges, by this mode. However. the ink may be applied without being thinned out for printing to cover part of the-edges, when frequency can be doubled to operate the head driving circuit for this mode.

More concrete constitutions of Embodiment 3 and modifications thereof are briefly described below.

Figure 19:
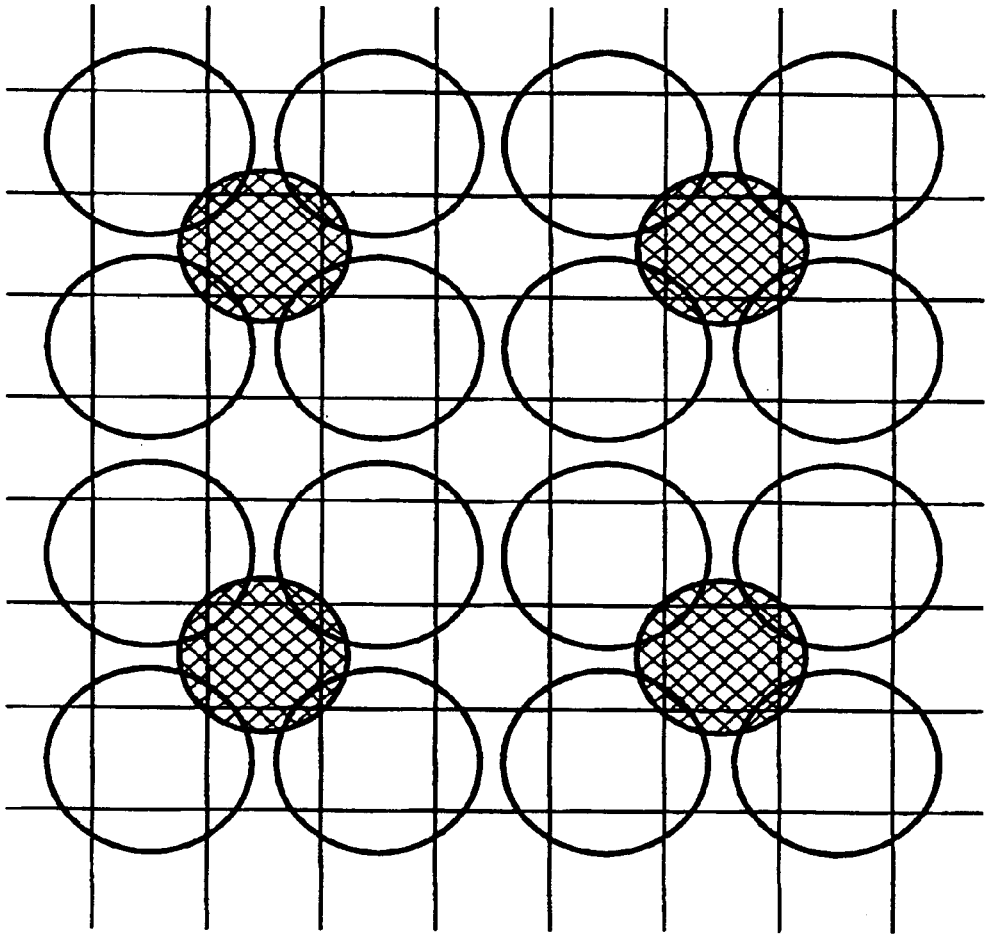
FIG. 19 is an illustration illustrating thinned-out processing liquid relative to the black ink dots.
Figure 19:
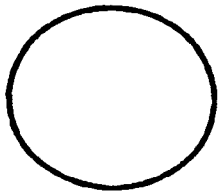
Figure 19:
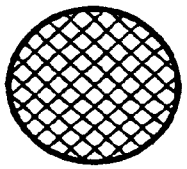

Consider realizing ink saving and high printing density simultaneously in a full multi-printer which performs one-path printing by means of heads arranged in a manner shown in FIG. 15, the printer can have the heads 101 each provided with the nozzles (ejection portions) arranged at range at least as wide as the printing width. A density of the nozzle arrangement directly reflects resolution of the images printed by such full multi head. In this embodiment, the head has nozzles at a density of 600 dpi, and the Bk ink contains a colorant of a 50%–50% mixture of an anionic, self dispersion type carbon pigment and anionic dye, which is dissolved in 10% to 20% of a solvent in the presence of a small quantity of surfactant to set its penetrability at a low level. When acetylnol is used as the surfactant, its content is limited to 0% to around 0.2%. An ejection amount is preferably set at 20 pl to 30 pl. The liquid is thinned out in a checker patterned manner at a ratio of 50%, as shown in FIG. 16, to secure uniformity of thinning. The processing liquid is applied to reach the printing medium around 0.1 to 2 sec after the Bk dot is formed, the time interval varying depending on ink composition. The processing liquid contains a cationic polymer and cationic surfactant at a total content of around 4% content of the surfactant being set at around 0.7 to 3% when it is acetylenol to improve its penetrability. Its thinning-out ratio is preferably 1/9 or more, as shown in FIG. 19, to keep the processing liquid in contact with the Bk dot and thereby to improve print waterproofness.

An eject amount of the processing liquid is preferably set at a fairly low level of 15 pl to 20 pl; increasing the amount beyond the above level may excessively run the solution to increase dot size, as its penetrability increases. It is preferable to change thinning-out mode for the processing liquid by, e.g., changing error diffusion parameters or patterns (e.g., keeping some as given and the others random based on error diffusion). It may be thinned out in the nozzle arrangement direction, as shown in FIG. 17.

Another example of printer configuration arranges the heads in a manner shown in FIG. 15, where the upper limit of head driving frequency is set at, e.g., 2 kHz, and the printing medium is conveyed at a frequency of 4 kHz as that for the space between dot positions. The nozzles in the head are driven at 2 kHz, while shifting the phase by half on every other nozzle. The even-numbered and odd-numbered nozzles may be separately driven. This gives ink eject corresponding to printing at 2 kHz for the nozzles as a whole, but checker pattern printing at 4 kHz on the printing medium. Thus, the checker pattern printing is effected at a thinning-out ratio of 1/2 at the highest both for the processing liquid and ink. The processing liquid is further thinned out to 1/2 to 1/4 on the data.

The checker pattern printing is also effected with the color inks (e.g., Y, M and C inks) at the thinning-out ratio of 1/2. This may be accompanied by decreased printing density, but the print may be left as it is as the checker pattern print formed at a thinning-out ratio of 1/2 at the highest, when color printing density is not a serious matter.

Still another embodiment of the present invention will be described. It applies a processing liquid at varying rate, depending on density level of the image data to be printed.

For example, printing is controlled for a printer in such a way to directly supply image data for the ink ejection head, and supply the image data, after they are thinned out at a printing ratio (i.e., thinning-out ratio) corresponding to density of the image data, for the processing liquid ejection head.

This can realize a clear gradation on the printed image by determining the thinning-out ratio so as to cause change in density of the printed image depending upon density level shown by the image data. Density of the printed image can be changed by setting thinning-out ratio in accordance with the image data, when its density is to be increased or conversely decreased as a whole.

As described above, each of the embodiments of the present invention applies the thinned-out processing liquid relative to the ink to make its quantity small. The product of the reaction between the ink and reduced quantity of the processing liquid is prevented from penetrating deep into the printing medium but accelerated to spread over the medium surface. As a result, the product tends to be concentrated in a relatively shallow surface layer of the printing medium, to increase OD.

Therefore, the method of the present invention gives the printed image of high OD and low strike-through OD, and, at the same time, can improve fixation, when the processing liquid is more penetrative than the ink.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. An ink printing method of forming an image on a printing medium by using an ink containing a pigment, said method comprising the step of:

applying a processing liquid which contains processing material which accelerates solidification of the pigment in the ink containing the pigment and contains a surfactant as a penetrant, the surfactant being contained at a concentration of critical micelle concentration with water or higher to show high penetrability, to the ink containing the pigment;

wherein the processing liquid and the ink are applied in said applying step so that an applying quantity of the processing liquid per unit area is smaller than an applying quantity of the ink per unit area.

2. An ink printing method as claimed in claim 1, wherein the processing liquid contains a polymer having polarity opposite to that of the pigment.

3. An ink printing method as claimed in claim 1, wherein the pigment is self-dispersing type pigment.

4. An ink printing method of performing printing, comprising the step of applying a processing liquid which accelerates solidification of a pigment after applying ink containing the pigment to a printing medium, wherein the processing liquid contains an insolubilizer of polymer and contains a surfactant as a penetrant, the surfactant being contained at a concentration of critical micelle concentration with water or higher to be highly penetrative, wherein and the processing liquid is applied at 50% or less in quantity of the ink applied to the printing medium.

5. An ink printing method as claimed in claim 3, wherein the insolubilizer of polymer is polyarylamine.

6. An ink printing method as claimed in claim 5, wherein the pigment is carbon black.

7. An ink printing method as claimed in claim 6, wherein dye is used together with the carbon black for ink colorant.

8. An ink printing method, comprising the step of applying an ink, wherein the ink contains a pigment as a colorant and has a penetration coefficient Ka, which is a proportional coefficient for time span after penetration of the ink is started, when a quantity of the ink penetrated is proportional to ½th order of the time span, of less than 1.0, onto a printing medium at a given quantity per unit area, and then applying a processing liquid, which coagulates the colorant by the reaction, and has a penetration coefficient Ka of 5.0 or more, onto the printing medium at a given quantity per unit area.

9. An ink printing method, comprising the step of applying an ink, wherein an ink containing a pigment as a colorant and having a penetration coefficient Ka, which is a proportional coefficient for time span after penetration of the ink is started, when quantity of the ink penetrated is proportional to ½th order of the time span, of less than 1.0 in a thinned out manner onto a printing medium, and then applying a processing liquid containing an insolubilizer of polymer which coagulates the colorant by the reaction and has a penetration coefficient Ka of 5.0 or more onto the printing medium in a thinned out manner.

10. An ink printing method as claimed in claim 9, wherein the pigment is carbon black.

11. An ink printing method as claimed in claim 10, wherein the ink is a mixture of the pigment and dye for the colorant.

12. An ink printing method as claimed in claim 11, wherein the pigment is an anionic pigment, the dye is anionic dye and the processing liquid contains a cationic polymer.

13. An ink printing method as claimed in claim 9, wherein the ink to be applied before the processing liquid is thinned out while keeping an area factor no less than 100%.

14. An ink printing method as claimed in claim 9, wherein the ink to be applied before the processing liquid is thinned out at a ratio above zero but ½ or less.

15. An ink printing method as claimed in claim 9, wherein the ink to be applied before the processing liquid is thinned out while keeping an area factor less than 100%.

16. An ink printing method as claimed in claim 9, wherein the processing liquid applied after the ink is thinned out to an extent at least on a level with that for said ink.

17. An ink printing method as claimed in claim 9, wherein the processing is liquid applied after the ink is thinned out to an extent above that for said ink.

18. An ink printing method as claimed in claim 9, wherein the processing liquid is thinned out at a rate of 1/2 to 1/9 of said ink.

19. An ink printing method as claimed in claim 9, wherein the ink and processing liquid are thinned out uniformly for data of the same printing density level.

20. An ink printing method of forming an image on a printing medium by using an ink containing a pigment, said method comprising the step of:

applying a processing liquid which contains processing material which accelerates solidification of the pigment in the ink containing the pigment and contains a surfactant as a penetrant, the surfactant being contained at a concentration of critical micelle concentration with water or higher to show higher penetrability to the printing medium than that of the ink, to the ink containing the pigment, wherein the processing liquid and the ink are applied in said applying step so that an applying quantity of the processing liquid per unit area is smaller than an applying quantity of the ink per unit area.

21. An ink printing apparatus for performing printing by applying a processing liquid which accelerates solidification of a pigment after applying ink containing the pigment to a printing medium, said apparatus comprising:

means for applying an ink containing a pigment as a colorant and having a penetration coefficient Ka, which is a proportional coefficient for time span after penetration of the ink is started, when quantity of the ink penetrated is proportional to ½th order of the time span, of less than 1.0, in a thinned out manner onto a printing medium, and then applying a processing liquid which coagulates the colorant by the reaction and has a penetration coefficient Ka of 5.0 or more, onto the printing medium in a thinned out manner, wherein the processing liquid contains an insolubilizer of polymer and is highly penetrative and the processing liquid is applied so that an applying ratio of the processing liquid per unit area is smaller than an applying ratio of the ink per unit area.

22. An ink printing apparatus, wherein an ink containing a pigment as a colorant and having a penetration coefficient Ka, which is a proportional coefficient for time span after penetration of the ink is started, when quantity of the ink penetrated is proportional to ½th order of the time span, of less than 1.0, is applied in a thinned out manner onto a printing medium, and then a processing liquid containing an insolubilizer of polymer which coagulates the colorant by the reaction and has a penetration coefficient Ka of 5.0 or more, is applied onto the printing medium in a thinned out manner.

23. An ink printing apparatus as claimed in claim 22, which has a plurality of printing modes for each thinning-out ratio of the processing liquid or ink.

24. An ink printing apparatus as claimed in claim 23, wherein the ink and processing liquid are ejected from respective printing heads to be applied onto the printing medium, and the respective printing heads generate a bubble in the ink or processing liquid by utilizing thermal energy to allow the bubble to provide a pressure to eject the ink or processing liquid.

25. An ink printing apparatus for forming an image on a printing medium by using an ink containing a pigment, said apparatus comprising:

image forming means for applying a processing liquid which contains processing material which accelerates solidification of the pigment in the ink containing the pigment and shows high penetrability to the ink containing the pigment, said image forming means differentiating a quantity of the processing liquid per unit area from a quantity of the ink containing the pigment per unit area to form an image different in density from the image formed on the printing medium with the ink containing the pigment, and means for varying the quantity of the high penetrative processing liquid per unit area, which is applied by said image forming means, according to a density of an image to be formed.

26. An ink printing apparatus as claimed in claim 25, wherein said means varies said quantity of the high penetrative processing liquid to express a gradation of the image formed.

27. An ink printing apparatus as claimed in claim 25, wherein said means for varying varies said quantity of the high penetrative processing liquid to form the image having a higher density than that formed with the ink containing the pigment.

28. An ink printing apparatus as claimed in claim 25, wherein said means for varying varies said quantity of the high penetrative processing liquid to form the image having a lower density than that formed with the ink containing the pigment.

29. An ink printing method for forming an image on a printing medium by using an ink containing a pigment, said method comprising the steps of:

applying a processing liquid which contains processing material which accelerates solidification of the pigment in the ink containing the pigment and shows higher penetrability to the printing medium than that of the ink, to the ink containing the pigment, said applying step differentiating a quantity of the processing liquid per unit area from a quantity of the ink containing the pigment per unit area to form an image different in density from the image formed on the printing medium with the ink containing the pigment, and varying the quantity of the high penetrative processing liquid per unit area, which is applied by said applying step, according to a density of an image to be formed.

* * * * *

UNITED STATES PATENT AND TRADEMARK OFFICE

CERTIFICATE OF CORRECTION

PATENT NO. : 6,471,347 B1 
DATED : October 29, 2002
INVENTOR(S) : Noribumi Koitabashi et al.

It is certified that error appears in the above-identified patent and that said Letters Patent is hereby corrected as shown below:

Title page,
Item [56], References Cited, OTHER PUBLICATIONS, "Inni et al.," should read -- Inui et al., --.
Item [57], ABSTRACT,
Line 7, "φ" should be deleted.

Column 1,
Line 31, "waterproofness" should read -- waterproofing --.

Column 3,
Line 9, "is" should be deleted.

Column 6,
Line 17, "(ml•m$^{-2}$•msec $^{½}$)" should read -- (ml•m$^{-2}$•msec $^{-1/2}$) --.

Column 7,
Line 14, "above-described" should read -- above-described --.
Line 37, "constant is" should read -- constant --.

Column 12,
Line 59, "each" should read -- with each --.

Column 14,
Line 30, "In" should read -- in --.

Column 18,
Line 51, "However." should read -- However, --.
Line 53, "the-edges," should read -- the edges, --.

Column 20,
Line 41, "wherein and" should read -- and wherein --.
Line 44, "claim 3," should read -- claim 4, --.
Lines 52 and 63, "Ka," should read -- Ka (ml•m$^{-2}$•msec $^{-1/2}$), --.
Line 59, "Ka" should read -- Ka (ml•m$^{-2}$•msec $^{-1/2}$) --.

Column 21,
Lines 1 and 60, "Ka" should read -- Ka (ml•m$^{-2}$•msec $^{-1/2}$) --.
Line 25, "is liquid" should read -- liquid is --.
Line 53, "Ka," should read -- Ka (ml•m$^{-2}$•msec $^{-1/2}$), --.

UNITED STATES PATENT AND TRADEMARK OFFICE

CERTIFICATE OF CORRECTION

PATENT NO. : 6,471,347 B1 
DATED : October 29, 2002
INVENTOR(S) : Noribumi Koitabashi et al.

It is certified that error appears in the above-identified patent and that said Letters Patent is hereby corrected as shown below:

Column 22,
Line 1, "Ka," should read -- Ka ($ml \bullet m^{-2} \bullet msec^{-1/2}$), --.
Line 7, "Ka" should read -- Ka ($ml \bullet m^{-2} \bullet msec^{-1/2}$) --.

Signed and Sealed this

Twenty-first Day of October, 2003

JAMES E. ROGAN
*Director of the United States Patent and Trademark Office*